US007722142B2

(12) United States Patent
Hiwada et al.

(10) Patent No.: US 7,722,142 B2
(45) Date of Patent: May 25, 2010

(54) INK-JET PRINTER

(75) Inventors: Shuhei Hiwada, Toyoake (JP); Tomoyuki Kubo, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 12/151,867

(22) Filed: May 9, 2008

(65) Prior Publication Data

US 2008/0218546 A1 Sep. 11, 2008

Related U.S. Application Data

(62) Division of application No. 11/142,985, filed on Jun. 1, 2005, now Pat. No. 7,390,070.

(30) Foreign Application Priority Data

Jun. 4, 2004 (JP) ..... 2004-167241
Jun. 23, 2004 (JP) ..... 2004-184937

(51) Int. Cl.
*B41J 29/38* (2006.01)

(52) U.S. Cl. ..... 347/5; 347/13; 347/15

(58) Field of Classification Search ..... 347/5, 347/9–12, 13, 15, 19, 14
See application file for complete search history.

(56) References Cited

U.S. PATENT DOCUMENTS 5,157,411 A * 10/1992 Takekoshi et al. ..... 347/13
5,353,051 A 10/1994 Katayama et al.
5,896,146 A 4/1999 Murata et al.
5,969,730 A 10/1999 Inose et al.
6,039,425 A * 3/2000 Sekiya et al. ..... 347/15
6,104,178 A 8/2000 Sugimoto
6,183,056 B1 2/2001 Corrigan et al.
6,290,317 B1 * 9/2001 Hotomi ..... 347/15

(Continued)

FOREIGN PATENT DOCUMENTS

JP 3-277553 12/1991

(Continued)

*Primary Examiner*—Lam S Nguyen
(74) *Attorney, Agent, or Firm*—Frommer Lawrence & Haug LLP

(57) ABSTRACT

An ink-jet printer including: an ink-jet head in which are disposed a plurality of nozzles that are divided into a plurality of nozzle groups; a plurality of actuators which are provided to respectively correspond to the plurality of nozzles and which are divided into a plurality of actuator groups respectively corresponding to the plurality of nozzle groups; a plurality of drive circuits which are provided respectively for the plurality of nozzle groups and each of which outputs a drive signal used for ejecting an ink, to the plurality of actuators of a corresponding one of the plurality of actuator groups; a controller which controls the ink-jet printer to perform printing such that, by driving any of the plurality of actuators which are determined on the basis of print data, the ink is ejected, toward a recording medium, from any of the plurality of nozzles that correspond to said any of the plurality of actuators; and an adjusting portion which adjusts the drive signal to be outputted from each of the plurality of drive circuits to reduce variation in an ink-ejection property among the plurality of nozzle groups.

10 Claims, 14 Drawing Sheets

U.S. PATENT DOCUMENTS

| | | | | |
|---|---|---|---|---|
| 6,290,333 | B1 | 9/2001 | Wade et al. | |
| 7,390,070 | B2 * | 6/2008 | Hiwada et al. | 347/10 |
| 7,530,653 | B2 * | 5/2009 | Hirayama | 347/9 |
| 2007/0211095 | A1 * | 9/2007 | Hirayama | 347/14 |

FOREIGN PATENT DOCUMENTS

| | | |
|---|---|---|
| JP | A-8-258292 | 10/1996 |
| JP | 10-217464 | 8/1998 |
| JP | 11-192702 | 7/1999 |
| JP | 2000-263818 | 9/2000 |
| JP | 2001-054948 | 2/2001 |
| JP | B2-3174228 | 3/2001 |
| JP | 2001-150666 | 6/2001 |
| JP | 2002-211011 | 7/2002 |
| JP | 2002-326352 | 11/2002 |
| JP | 2002-331662 | 11/2002 |
| JP | 2003-154669 | 5/2003 |
| JP | 2003-170588 | 6/2003 |
| JP | 2003-291339 | 10/2003 |
| JP | 2004-001545 | 1/2004 |
| JP | 2004-090524 | 3/2004 |

* cited by examiner

52 DOT PRINT SIGNAL

53 TRANSFER CLOCK SIGNAL

54 DOT PRINT SIGNAL

59 EJECTION SIGNAL (FIRE INPUT SIGNAL)

62 ENCODER SIGNAL

FIG.5

CORRECTION TABLE Ta1

| IDENTIFICATION DATA | CHARACTERISTIC DATA (CORRECTION VALUE) |
|---|---|
| IC1 | +a5 |
| IC2 | +a4 |
| IC3 | +a3 |
| IC4 | +a2 |
| IC5 | +a1 |
| IC6 | ±0 |
| IC7 | −a1 |
| IC8 | −a2 |
| IC9 | −a3 |
| IC10 | −a4 |
| IC11 | −a5 |

FIG.8

CORRECTION TABLE Ta2

| IDENTIFICATION DATA (RISE TIME Tr) | CHARACTERISTIC DATA (CORRECTION VALUE) |
|---|---|
| $Tr1 \leqq Tr < Tr2$ | +a2 |
| $Tr2 \leqq Tr < Tr3$ | +a1 |
| $Tr3 \leqq Tr < Tr4$ | ±0 |
| $Tr4 \leqq Tr < Tr5$ | −a1 |
| $Tr5 \leqq Tr < Tr6$ | −a2 |

Tr1 ⟷ Tr6

SHORT LONG

52 DOT PRINT SIGNAL

53 TRANSFER CLOK SIGNAL

54 DOT PRINT SIGNAL

59 EJECTION SIGNAL (FIRE INPUT SIGNAL)

62 ENCODER SIGNAL

DRIVER IC 300 : Tr1 Tf1

DRIVER IC 301 : Tr2 Tf2

INK-JET PRINTER

The application is a divisional application of U.S. patent application Ser. No. 11/142,985 filed on Jun. 1, 2005, U.S. Pat. No. 7,390,070, which claims priority from Japanese Patent Application Nos. 2004-167241 and 2004-184937 filed on Jun. 4, 2004, and Jun. 23, 2004, respectively, the contents of which are incorporated herein by reference.

BACKGROUND OF THE INVENTION

1. Field of the Invention

The present invention relates in general to an ink-jet printer which performs printing by ejecting ink from nozzles toward a recording medium upon driving of actuators.

2. Discussion of Related Art

Recently, in this type of ink-jet printer, the nozzles tend to be disposed at high density for attaining a high degree of printing quality. To deal with this, there is proposed a technique to drive the actuators by a plurality of driver ICs, as disclosed in U.S. Pat. No. 5,896,146 corresponding to JP-A-8-258292.

In the plurality of driver ICs, however, there exists variation in the property thereof generated during production thereof, so that a fall time and a rise time of a drive signal outputted therefrom are not constant among the mutually different driver ICs. Accordingly, there is generated a difference in an ink-droplet-ejection property among the nozzles of IC output channel areas which respectively correspond to the mutually different driver ICs. Namely, the speed of ejecting the ink droplet, the volume of the ink droplet, and the ink-ejection stability are adversely influenced, whereby the printing quality of the ink-jet printer is undesirably deteriorated.

FIG. 14A is a view for explaining an ink-jet head in which two driver ICs 300, 301 are provided. FIG. 14B is a view for explaining drive signals which are outputted from the respective two driver ICs 300, 301. This ink-jet head performs color printing operation by ejecting inks of four different colors, i.e., black, yellow, cyan, and magenta. For each of the four different colors of inks, a plurality of nozzle rows are provided. The plurality of nozzle rows are divided into two areas, as seen in a direction of extension of the nozzle rows, that is, an IC1 output channel area corresponding to the driver IC 300 and an IC2 output channel area corresponding to the driver IC 301.

As shown in FIG. 14B, where a rise time Tr1 and a fall time Tf1 of a pulse of the drive signal outputted from the driver IC 300 are respectively shorter than a rise time Tr2 and a fall time Tf2 of a pulse of the drive signal outputted from the driver IC 301, the ink-droplet ejecting speed in the IC1 output channel area corresponding to the driver IC 300 is higher than the ink-droplet ejecting speed in the IC2 output channel area corresponding to the driver IC 301. Where the drive voltage to be applied to the actuators is the same, the volume of the ink droplet to be ejected is determined depending upon the pulse width of the pulse and the timing at which the drive voltage is applied to the actuators. However, there is generated a difference in the volume of the ink droplet between the two channel areas due to the difference in the rise time and the fall time between the pulse of the drive signal outputted from the driver IC 300 and the pulse of the drive signal outputted from the driver IC 301 as described above.

Accordingly, there is caused a difference in the attaching position to which the ink droplet attaches and a difference in the print concentration, between the adjacent two print regions which respectively correspond to the two channel areas corresponding to the respective driver ICs. Where the difference in the print concentration is generated between the two channel areas, a banding phenomenon is caused due to the difference.

It is therefore an object of the present invention to improve printing quality of an ink-jet printer having a plurality of nozzles which are divided into a plurality of nozzle groups and a plurality of drive circuits which are respectively provided for the plurality of nozzle groups.

SUMMARY OF THE INVENTION

The object indicated above may be achieved according to a principle of the invention, which provides an ink-jet printer comprising: an ink-jet head in which are disposed a plurality of nozzles that are divided into a plurality of nozzle groups; a plurality of actuators which are provided to respectively correspond to the plurality of nozzles and which are divided into a plurality of actuator groups respectively corresponding to the plurality of nozzle groups; a plurality of drive circuits which are provided respectively for the plurality of nozzle groups and each of which outputs a drive signal used for ejecting an ink, to the plurality of actuators of a corresponding one of the plurality of actuator groups; a controller which controls the ink-jet printer to perform printing such that, by driving any of the plurality of actuators which are determined on the basis of print data, the ink is ejected, toward a recording medium, from any of the plurality of nozzles that correspond to said any of the plurality of actuators; and an adjusting portion which adjusts the drive signal to be outputted from each of the plurality of drive circuits to reduce variation in an ink-ejection property among the plurality of nozzle groups. The "drive circuit" is a circuit necessary for outputting the drive signal and may be constituted by driver ICs. For instance, the drive circuit may be constituted by including ejection-signal generating circuits in addition to the driver ICs.

According to a first aspect of the invention, the adjusting portion adjusts the drive signal to be outputted from said each of the plurality of drive circuits, such that the ink-ejection property of each of the plurality of nozzles in each of the plurality of nozzle groups is equal to a predetermined ink-ejection property. In this aspect, the predetermined ink-ejection property of the above-indicated each of the plurality of nozzles may be identical to each other. The "ink-ejection property" is interpreted as a speed of ejection of an ink droplet, a volume of the ink droplet, ink-ejection stability and so on. The "predetermined ink-ejection property" is interpreted, for instance, as an ink-ejection property which is set in advance.

According to a second aspect of the invention, the adjusting portion adjusts a characteristic of the drive signal to be outputted from said each of the plurality of drive circuits so as to coincide with each other. The "characteristic of the drive signal" is interpreted as a rise-time, a fall-time, and a pulse width, of a pulse of the drive signal, a number of pulses in a single drive signal, a voltage and a current of the drive signal, and so on. Where the ink-ejection property of the nozzles of each of the plurality of nozzle groups which respectively correspond to the plurality of drive circuits is conformed to each other, no difference in the printing quality is generated among a plurality of print regions that respectively correspond to the plurality of nozzle groups, thereby enhancing the printing quality of an entire print region of the recording medium.

FORMS OF THE INVENTION

The present invention may be practiced in various forms. Each of the various forms will be explained, together with the effect based on each form.

In a first preferred form of the invention, the adjusting portion includes: a storing section which stores characteristic data used for changing a characteristic of the drive signal to be outputted from each of the plurality of drive circuits and identification data used for identifying the plurality of drive circuits, the characteristic data and the identification data being stored so as to be related to each other; and an adjust-signal outputting section which reads, from the storing section, and outputs, to each of the plurality of drive circuits, one of the characteristic data which corresponds to said each of the plurality of drive circuits, as an adjust signal used for adjusting said each of the plurality of drive circuits, and said each of the plurality of drive circuits is arranged to output the drive signal whose characteristic has been adjusted, based on the adjust signal inputted thereto. This first preferred form is a particularly effective form of the first aspect of the invention.

The "storing section" is constituted by, for instance, a characteristic data table in which characteristic data and identification data are related to each other. In the above-indicated first preferred form, "said each of the plurality of drive circuits is arranged to output the drive signal whose characteristic has been adjusted, based on the adjust signal inputted thereto" means that each of the plurality of drive circuits is arranged to change the characteristic of the drive signal to be outputted therefrom, into the characteristic represented by the adjust signal inputted thereto. For instance, the pulse width, the number of pulses, the voltage, etc., of the drive signal to be outputted from each drive circuit are adjustable.

In the above-indicated first preferred form of the invention, the adjust signal is inputted to each drive circuit whereby the characteristic of the drive signal to be outputted from each drive circuit can be changed into the characteristic represented by the adjust signal. Therefore, where the characteristic of the drive signal to be outputted from each of the plurality of drive circuits is conformed to each other, there is no reduction in the printing quality due to a difference in the characteristic of the drive signal among the plurality of drive circuits. Further, each drive circuit is arranged to output the drive signal whose characteristic has been adjusted based on the adjust signal inputted thereto, thereby omitting a step of connecting an additional circuit for adjusting the drive signal.

In one advantageous mode of the above-indicated first preferred form, the storing section stores the characteristic data which includes data that corresponds to a difference between a reference drive signal and the drive signal of said each of the plurality of drive circuits and the identification data which includes data that corresponds to at least one of a rise time and a fall time of a pulse of the drive signals of said each of the plurality of drive circuits, the adjusting portion further includes a time-measuring section which measures at least one of the rise time and the fall time of the pulse of the drive signal outputted from said each of the plurality of drive circuits, and the adjusting portion is arranged such that the characteristic data is read out from the storing section, based on a result of the measurement obtained by the time-measuring section.

The characteristic of the drive signal is specified by a rise time, a fall time, a pulse width, of a pulse of the drive signal, a number of pulses in a single drive signal, a voltage of the drive signal, and so on. Above all, the pulse width largely influences the ink-ejection property, in particular, the volume of the ink droplet. In view of this, the printing quality can be effectively enhanced by eliminating the variation in the pulse width. Further, a change in the pulse width corresponds to a change in the rise time or the fall time of a pulse, and therefore the variation in the pulse width can be grasped or recognized as the variation in the rise time or the fall time of the pulse. Accordingly, if the rise time or the fall time of the drive signal is obtained, the pulse width can be obtained. Further, if the rise time or the fall time is obtained, the driver circuit can be identified. In view of these, the above-indicated advantageous mode was developed. According to the advantageous mode described above, by measuring at least one of the rise time or the fall time of the pulse of the drive signal, the drive signal to be outputted from each drive circuit can be adjusted such that the ink-ejection property of the nozzles of each nozzle group is equal to the predetermined ink-ejection property, thereby enhancing the printing quality of the entire print region since there exists no difference in the printing quality among the print regions corresponding to the plurality of nozzle groups.

In a second preferred form of the invention, the adjusting portion is constituted by an arrangement that one of the plurality of drive circuits outputs a reference signal used for conforming the characteristic of the drive signal to be outputted from said each of the plurality of drive circuits to each other, to the other of the plurality of drive circuits, and an arrangement that the other of the plurality of drive circuits is arranged such that the reference signal is inputted thereto and such that a characteristic of the drive signal thereof coincides with a characteristic of the drive signal of said one of the plurality of drive circuits. This second preferred form is a particularly effective form of the second aspect of the invention.

According to the above-indicated second preferred form, the one of the plurality of drive circuits outputs the reference signal to the other of the plurality of drive circuits, whereby all of the characteristics of the drive signals to be outputted respectively from the plurality of drive circuits can be conformed to one another. Moreover, owing to the other of the plurality of drive circuits arranged as described above, there is no need of connecting an additional circuit for conforming the characteristics to one another, to each drive circuit in adjusting the characteristics of the drive signal.

In the above-indicated second preferred form, the adjusting portion may include a setting-signal outputting section which outputs a setting signal used for setting any of the plurality of drive circuits as said one of the plurality of drive circuits, and said each of the plurality of drive circuits may be arranged to be set as said one of the plurality of drive circuits based on the setting signal inputted thereto.

According to this arrangement, because any of the plurality of drive circuits to which the setting signal has been inputted is set as said one of the plurality of drive circuits, any of the plurality of drive circuits which output the drive signal corresponding to a desired characteristic can be set as said one of the plurality of the drive circuits. Therefore, the characteristic of each drive circuit can be changed into the desired characteristic.

In one preferred form of the above-indicated second aspect, the adjusting portion includes a reference-signal outputting section which outputs, to said each of the plurality of drive circuits, a common reference signal used for conforming the characteristic of the drive signal to be outputted from said each of the plurality of drive circuits to each other, and said each of the plurality of drive circuits has a function of adjusting the characteristic of the drive signal to be outputted therefrom to a predetermined characteristic based on the common reference signal inputted thereto.

In the above-indicated one preferred form of the second aspect, the common reference signal is outputted to each drive circuit, whereby the characteristic of the drive signal to be outputted from each drive circuit can be adjusted to the predetermined characteristic. Accordingly, where the reference signal is arranged to be adjustable and the predetermined characteristic is arranged to be adjusted depending upon the adjusted reference signal, for instance, the characteristic of the drive signal of each drive circuit can be changed to the desired characteristic.

Where the reference-signal outputting section is arranged to include an electronic circuit which fixes physical quantity that specifies an electric signal, and the reference-signal outputting section is arranged to output, as the common reference signal, the electric signal whose physical quantity is fixed, the characteristic of the drive signal of each drive circuit can be adjusted to the predetermined characteristic with high reliability.

The pulse width of the drive signal and the number of pulses of a single drive signal give large influence mainly on the volume of the ink droplet, the ink-ejection stability and the like. The voltage of the drive signal gives large influence mainly on the ink-droplet ejecting speed. Further, by adjusting the current and the voltage of the drive signal outputted from each drive circuit, the rise time and the fall time of a pulse of the drive signal can be adjusted. Where the adjusting portion is arranged to adjust these factors, it is possible to eliminate variation in the volume of the ink droplet, the ink-ejection stability, the ink-droplet ejecting speed, the rise time or the fall time of the pulse of the drive signal and so on, resulting in increase in the printing quality.

Where the principle of the invention is applied to an ink-jet printer in which the plurality of nozzles are arranged in a plurality of rows that are respectively provided for a plurality of colors of inks, the color printing quality can be advantageously enhanced.

Where the principle of the invention is applied to an ink-jet printer in which the plurality of nozzles are arranged in a plurality of rows and the plurality of nozzle groups are defined by dividing the plurality of rows in a direction of extension of the plurality of rows, it is effective to prevent occurrence of the banding phenomenon.

The principle of this invention is applicable to an ink-jet printer having, as a drive source, actuators utilizing electrothermal converting elements, other than piezoelectric actuators utilizing electro-mechanical converting elements such as piezoelectric elements. Moreover, the principle of this invention is applicable to an ink-jet printer having ink cartridges provided on the ink-jet head or the head holder, an ink-jet printer having a scanning function or a copying function, or an ink-jet printer in which the ink-jet head is arranged not to be moved.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 5 is a view for explaining structure of a correction table stored in a ROM;

FIG. 8 is a view for explaining structure of another correction table stored in another ROM;

FIGS. 11A and 11B are block diagrams showing main construction of two driver ICs according to a first embodiment of the second aspect and a modified arrangement thereof, respectively, wherein FIG. 10A is for explaining a case in which a separate power source is provided and FIG. 10B is for explaining a case in which a reference generating circuit of one of the driver ICs is used as a power source;

FIGS. 12A and 12B are block diagrams showing main construction of two driver ICs according to a second embodiment of the second aspect and a modified arrangement thereof, respectively, wherein FIG. 12A is for explaining a case in which a driver IC functioning as a master is determined in advance and FIG. 12B is for explaining a case in which a master is determined depending upon output characteristics of the respective driver ICs;

FIGS. 13A and 13B are block diagrams showing main construction of two driver ICs according to a third embodiment of the second aspect and a modified arrangement thereof, respectively, wherein FIG. 13A is for explaining a case in which each driver IC is equipped with a maximum value circuit and FIG. 13B is for explaining a case in which each driver IC is equipped with a minimum value circuit.

DETAILED DESCRIPTION OF THE PREFERRED EMBODIMENT

Figure 1:
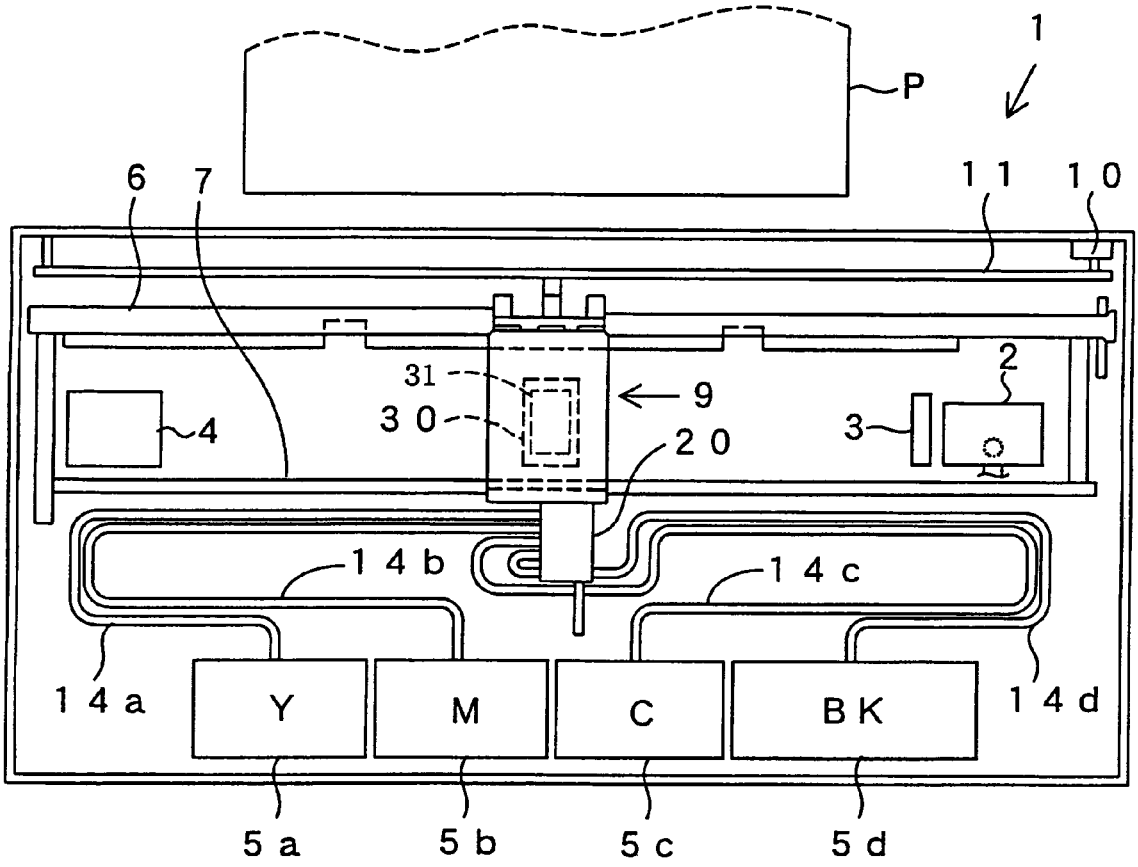
FIG. 1 is a plan view showing principal parts of an ink-jet printer to which a principle of the present invention is applied.

There will be described embodiments according to the first aspect of the present invention and embodiments according to the second aspect of the invention, referring to the drawings. It is to be understood that the present invention may be embodied with various other changes and modifications, which may occur to those skilled in the art, without departing from the spirit and scope of the invention.

1. Embodiments of the First Aspect

1-1. First Embodiment

<Principal Structure of Ink-Jet Printer>

Referring to a plan view of FIG. 1, there will be explained principal structure of an ink-jet printer 1 to which the principle of the invention is applied. In the ink-jet printer 1, there are provided two guide shafts 6, 7 to which is attached a head holder 9 functioning also as a carriage. The head holder 9 holds an ink-jet head unit 30 which performs printing operation by ejecting ink toward a sheet of paper P as a recording medium. The ink-jet head unit 30 includes an ink-jet head 31 in which nozzles are disposed and actuators which give energy for ink ejection to ink chambers (pressure chambers) communicating with the corresponding nozzles. In the ink-jet head 31, there are provided a black-ink nozzle row in which are arranged a plurality of nozzles for ejecting black-ink droplets, a yellow-ink nozzle row in which are arranged a plurality of nozzles for ejecting yellow-ink droplets, a cyan-ink nozzle row in which are arranged a plurality of nozzles for ejecting cyan-ink droplets, and a magenta-ink nozzle row in which are arranged a plurality of nozzles for ejecting magenta-ink droplets. The opening of each nozzle is opposed to a surface of the sheet of paper (on which printing is performed) fed into the ink-jet printer 1, with a predetermined spacing interposed therebetween. In individual flow passages which communicate with the corresponding nozzles, the ink chambers filled with ink are respectively provided. Actuators are provided to correspond to the respective ink chambers, so as to give energy for ink ejection to the ink chambers. In this embodiment, piezoelectric actuators (indicated at "32" in FIG. 2) utilizing piezoelectric elements are used as the actuators, and each piezoelectric actuator partially defines the corresponding ink chamber.

The head holder 9 is attached to an endless belt 11 which is driven by a carriage motor 10, and is reciprocated in a direction along the guide shafts 6, 7 by operation of the carriage motor 10. The ink-jet printer 1 has ink tanks 5*a*, 5*b*, 5*c*, 5*d* in which a yellow ink, a magenta ink, a cyan ink, and a black ink are respectively accommodated. The ink tanks 5*a*-5*d* are connected to a tube joint 20 via flexible tubes 14*a*-14*d*, respectively. Each of the inks accommodated in the respective ink tanks 5*a*-5*d* is supplied to the corresponding ink chambers via the tube joint 20.

At a left-side end of the ink-jet printer 1 as seen in the moving direction of the head holder 9, there is disposed an ink-absorbing member 4 for absorbing poor-quality or defective ink ejected from the nozzles during a flushing operation. On the other hand, at a right-side end of the ink-jet printer 1 as seen in the moving direction of the head holder 9, there is disposed a purge device 2 for sucking, from the nozzles, the poor-quality ink present in the inside of the ink-jet head unit 30. Further, on the left side of the purge device 2, there is disposed a wiping device 3 for wiping the ink adhering to the nozzle surface of the ink-jet head 31.

<Principal Structure of Control System>

Figure 2:
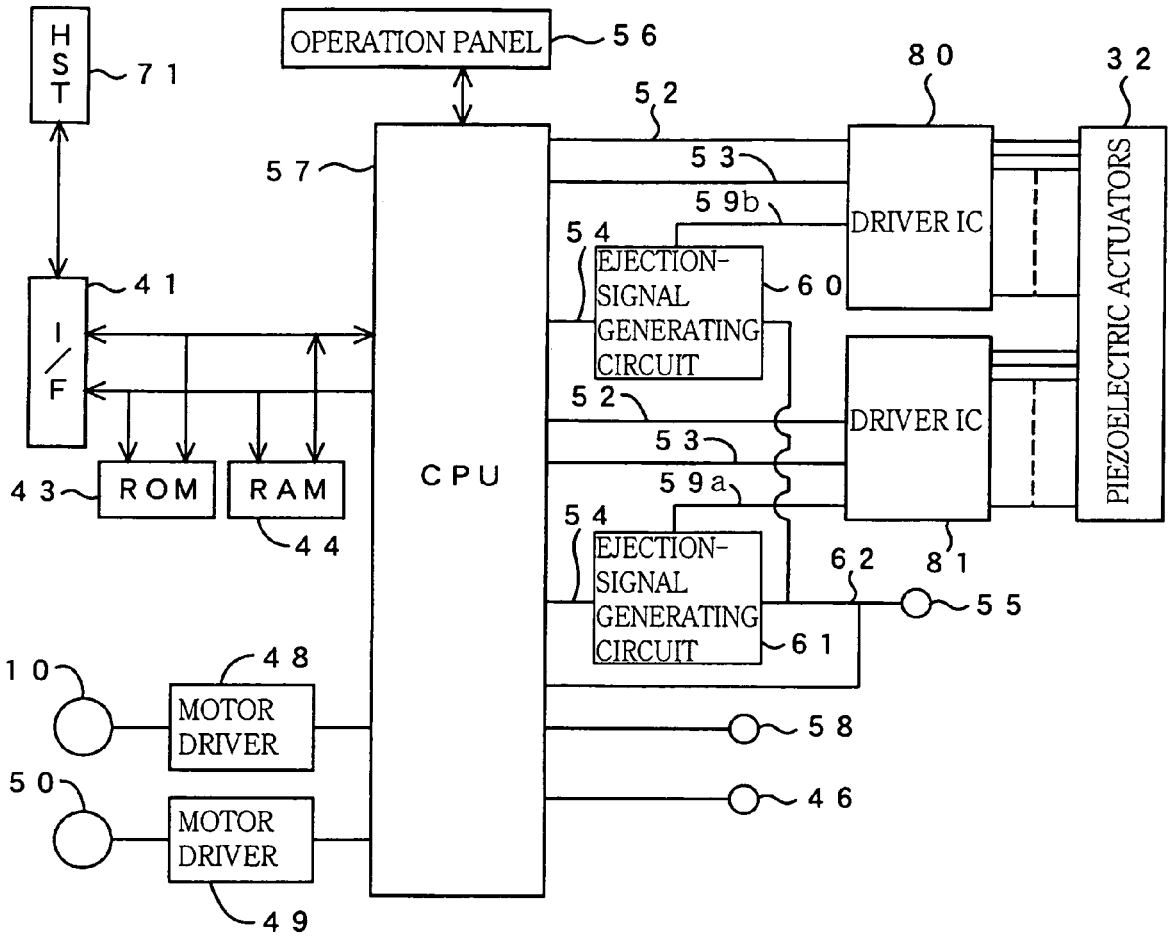
FIG. 2 is a block diagram showing principal parts of a control system of the ink-jet printer of FIG. 1, according to embodiments of the first aspect of the invention.

By referring next to the block diagram of FIG. 2, there will be explained principal structure of a control system of the ink-jet printer 1. The ink-jet printer 1 receives print data from a host computer (HST) 71. In the present embodiment, the printing operation is performed by controlling the piezoelectric actuators 32 based on the print data by two driver ICs 80, 81 each as a drive circuit. The ink-jet printer 1 is controlled by a CPU 57, and the received print data is developed into image data as a dot print signal 52, for instance. To the CPU 57, there are connected: an operation panel 56 through which is inputted by a user an indication of a pint mode, maintenance operation such as purging operation, or the like; a Centronics interface (I/F) 41 which receives an input from the host computer 71; a RAM 44 which temporarily stores data inputted through the operation panel 56; a ROM 43 which stores programs for driving various components; a motor driver 48 for driving the carriage motor 10; a motor driver 49 for driving a paper feed motor 50; a paper sensor 58 for detecting deviation of the sheet of paper P fed into the ink-jet printer 1, in the moving direction of the head holder 9 or in a direction perpendicular to the moving direction; a home-position sensor 46 for detecting whether the operation-start position of the ink-jet head unit 30 relative to the sheet of paper P is at a home position. To the CPU 57, there are further connected: the driver ICs 80, 81 for driving the ink-jet head unit 30; ejection-signal generating circuits 60, 61 for outputting ejection signals to the respective driver ICs 80, 81; and an encoder sensor 55 for reading a mark of each of strip-like timing index members (not shown) provided in the moving direction of the head holder 9 (the ink-jet head unit 30). In this embodiment, each ejection-signal generating circuit 60, 61 is constituted by an ASIC (Application Specific Integrated Circuit) such as gate arrays or standard cells.

Each of the driver ICs 80, 81 takes in a serial dot print signal 52 from the CPU 57 in synchronism with a transfer clock signal 53 outputted from the CPU 57, converts the serial dot print signal 52 to a parallel dot print signal corresponding to each channel by a serial-parallel conversion circuit, and outputs the converted dot print signal to an AND circuit provided for each channel.

The ejection-signal generating circuits 60, 61 generate ejection signals 59*a*, 59*b*, respectively, based on a print clock signal 54 outputted from the CPU 57, and output the ejection signals 59*a*, 59*b* to the AND circuits of the respective drive ICs 80, 81 so as to correspond to a cycle of an encoder signal 62 outputted from the encoder sensor 55. Each of the ejection signals 59*a*, 59*b* is a clock signal for giving indication of actual timing of ejection of the ink to the corresponding driver IC 80, 81. When the ejection signal is inputted to the AND circuit to which the dot print signal has been inputted, a logical product is equal to 1 and consequently the ejection signal is outputted from the AND circuit to an amplification circuit, so that the voltage of the ejection signal is amplified to a predetermined voltage. The voltage-amplified ejection signal is applied as a drive signal to an electrode of each piezoelectric actuator 32. It is noted that a controller is constituted by including the CPU 57, the ROM 43, the RAM 44, the ejection-signal generating circuits 60, 61, etc.

Figure 3A:
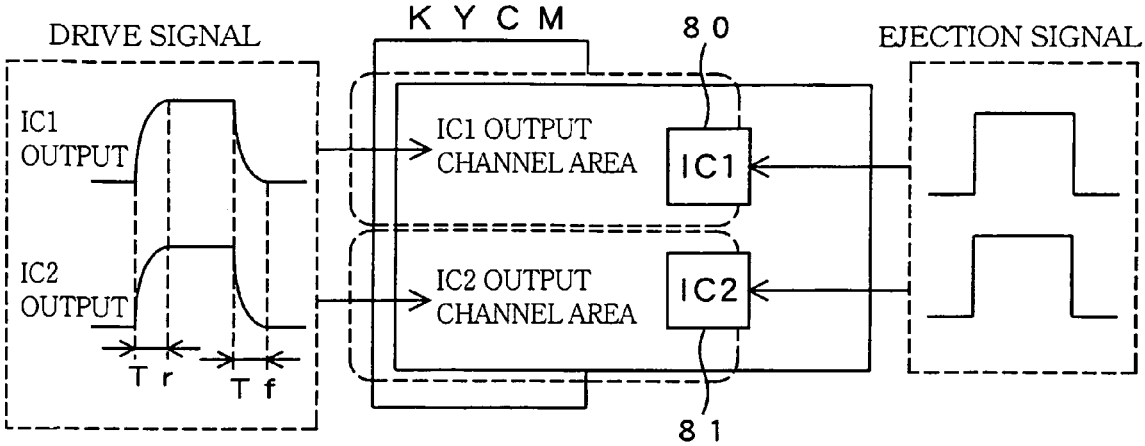
FIG. 3A is a view for explaining output channel areas which respectively correspond to two driver ICs.

FIG. 3A is a view for explaining output channel areas which correspond to the driver ICs 80, 81. A group of the black-ink nozzle row K, the yellow-ink nozzle row Y, the cyan-ink nozzle row C, and the magenta-ink nozzle row M is divided, as seen in a direction in which the rows extend, into two output channel areas, i.e., an IC1 output channel area which corresponds to the driver IC 80 and an IC2 output channel area which corresponds to the driver IC 81. The driver IC 80 outputs a drive signal to each of the piezoelectric actuators which belong to the IC1 output channel area while the driver IC 81 outputs a drive signal to each of the piezoelectric actuators which belong to the IC2 output channel area.

<Adjustment of Drive Signal>

Figure 3B:
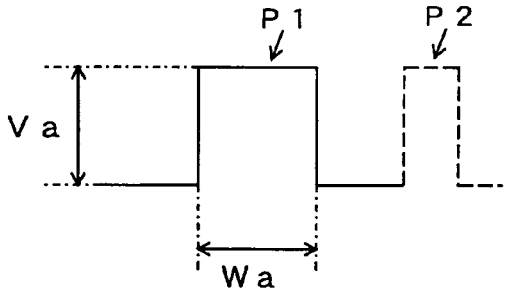
FIG. 3B is a view for explaining an ejection signal.
Figure 3C:
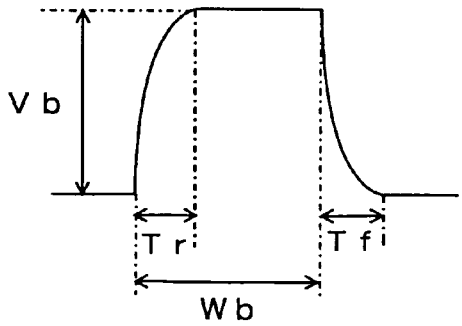
FIG. 3C is a view for explaining a drive signal.
Figure 4:
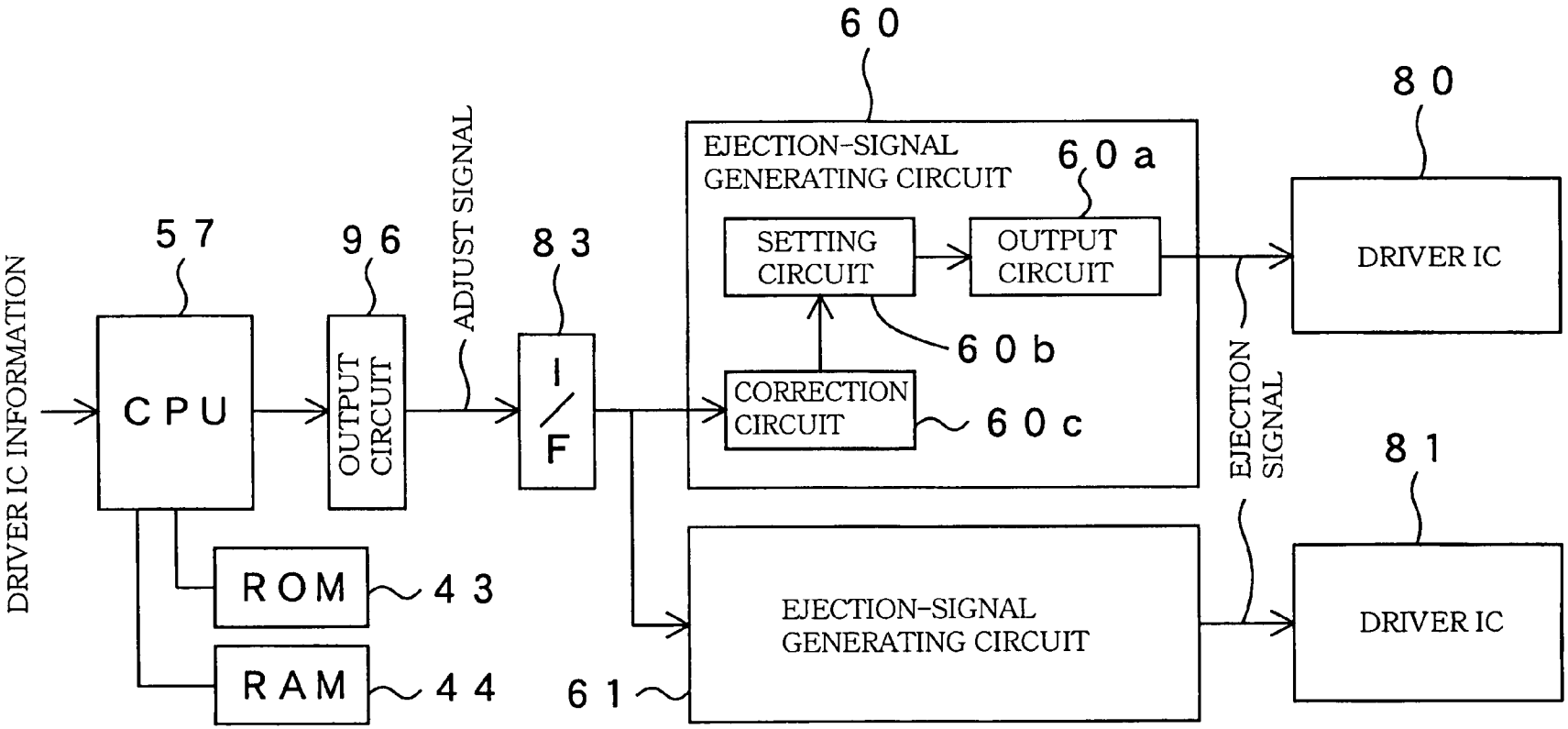
FIG. 4 is a block diagram showing a main electric structure which relates to adjustment of a pulse width of the drive signal.
Figure 6:
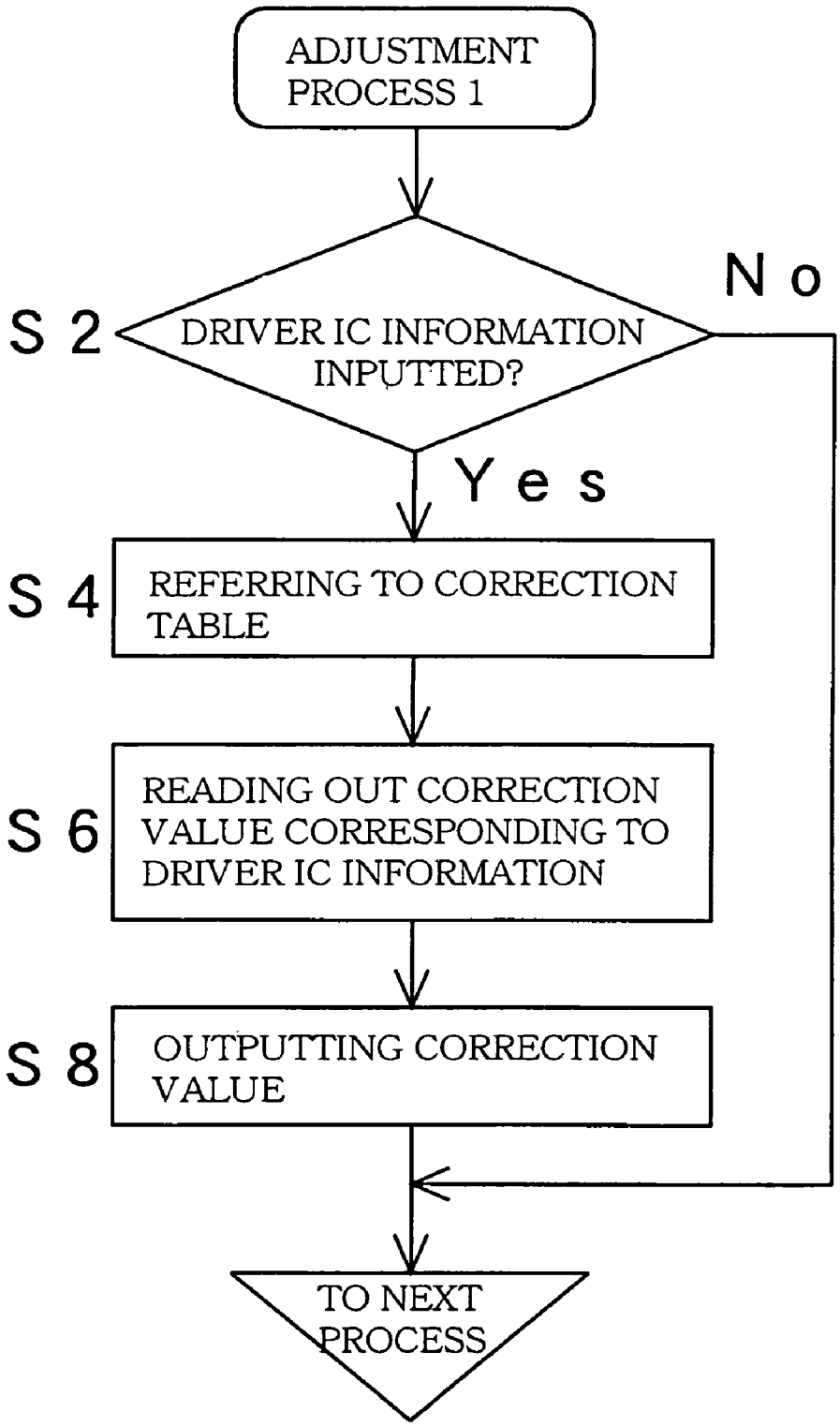
FIG. 6 is a flow chart showing adjustment process executed by a CPU.

Referring next to FIGS. 3B, 3C and 4-6, there will be explained adjustment for conforming a characteristic of the drive signals to be outputted from the driver IC 80 and a characteristic of the drive signals to be outputted from the driver IC 81 to each other. FIG. 3B is a view for explaining one of the ejection signals and FIG. 3C is a view for explaining one of the drive signals. FIG. 4 is a block diagram showing main electric structure which relates to adjustment of a pulse width of a pulse of the drive signals (hereinafter may be simply referred to as "pulse width" or "pulse width of the drive signals"). FIG. 5 shows structure of a correction table Ta1 stored in the ROM 43. FIG. 6 is a flow chart showing adjustment process 1 executed by the CPU 57.

(a) Relationship Between Ejection Signals and Drive Signals

The characteristic of the drive signals outputted from each of the driver ICs 80, 81 is expressed by a rise time Tr, a fall time Tf, a pulse width Wb, a voltage Vb, and a number of pulses, of a pulse represented by a waveform. The pulse width Wb of the drive signals increases with an increase in a pulse width Wa of the ejection signals while the pulse width Wb decreases with a decrease in the pulse width Wa. The voltage Vb of the drive signals increases with an increase in a voltage Va of the ejection signals while the voltage Vb decreases with a decrease in the voltage Va. Further, the number of pulses in a single drive signal of the drive signals increases with an increase in a number of pulses of a single ejection signal of the ejection signals, while the number of pulses in the single drive signal decreases with a decrease in the number of pulses in the single ejection signal. As shown in FIG. 3B, for instance, where the number of pulses increases from one to two by adding a pulse P2 to a pulse P1 of the single ejection signal, the number of pulses in the single drive signal also increases from one to two. It is noted that "single ejection signal" is an ejection signal which is outputted from each ejection-signal generating circuit 60, 61 for one dot print signal and that "single drive signal" is a drive signal outputted from each driver IC 80, 81 for one dot print signal.

(b) Relationship Between Characteristic of Drive Signals and Ink-Ejection Property In the present embodiment, the volume of the ink droplet is arranged to increase with an increase in the pulse width Wb of the drive signals and the volume of the ink droplet is arranged to decrease with a decrease in the pulse width Wb. Further, with an increase in the number of pulses of the single drive signal, the number of times of ink ejection for one dot print signal increases and the amount of ink ejected to a position corresponding to that one dot print signal increases, and as a result, a plurality of ink droplets overlap to form one dot on the recording medium. Moreover, with an increase in the number of pulses of the single drive signal, the ink-ejection stability increases where the timing and the pulse width of a pulse(s) added to the single drive signal are appropriate. Where the voltage Vb of the drive signals increases, the ink-droplet ejecting speed increases whereas the volume of the ink droplet and the ink-ejection stability varies. The present embodiment aims at eliminating variation in the volume of the ink droplet to be ejected, between the two channel output areas which respectively correspond to the two driver ICs 80, 81. For this end, in this embodiment, there will be explained a case in which the pulse widths of the drive signals to be outputted from the respective driver ICs 80, 81 are adjusted.

(c) Principal Structure of Ejecting-Signal Generating Circuits

As shown in FIG. 4, the ejection-signal generating circuit 60 includes an output circuit 60*a* which outputs the ejection signals, a setting circuit 60*b* which sets the pulse width Wa of the ejection signals, etc., and a correction circuit 60*c* which corrects the pulse width Wa of the ejection signals set at the setting circuit 60*b*, etc. The correction circuit 60*c* corrects the pulse width Wa of the ejection signals set at the setting circuit 60*b* in accordance with a correction value which is represented by an adjust signal outputted from an output circuit 96. In this embodiment, the setting circuit 60*b* includes a timer which adjusts the pulse width Wa of the ejection signals, i.e., a time period during which a pulse of the ejection signals is kept at a high level. The correction circuit 60*c* corrects the time period adjusted by the timer, thereby correcting the pulse width Wa of the ejection signals. The ejection-signal generating circuit 61 is similarly configured.

(d) Structure of Correction Table

The correction table Ta1 (shown in FIG. 5) stores identification data used for identifying driver ICs and characteristic data (correction values) used for changing the pulse width Wa of the ejection signals, such that the identification data and the characteristic data are related to each other. Where the rise time Tr of the drive signals changes, the width Wb thereof also changes, so that the volume of the ink droplet, etc., changes. However, since the rise time Tr is largely influenced by elements such as transistors that constitute each driver IC, it is rather difficult to correct the pulse width Wb of the drive signals by correcting the rise time Tr itself. Accordingly, in the present embodiment, the pulse width Wb of the drive signals is corrected, thereby eliminating the variation in the volume of the ink droplet.

In this embodiment, the identification data consists of eleven identification data for identifying eleven driver ICs (i.e., a driver IC1 through a driver IC11) in which the pulse widths Wb of the drive signals to be outputted respectively therefrom are mutually different. Further, the characteristic data (correction values) consists of eleven correction values (i.e., +a1 through +a5, −a1 through −a5, and ±0). Each of the correction values is for compensating for a difference between the pulse width of the drive signals outputted from each of the mutually different driver ICs and the pulse width of a drive signal as a reference (hereinafter may be referred to as "reference drive signal"). Each correction value is set as the characteristic data indicative of the characteristic of the drive signals of each of the driver ICs.

In this embodiment, the pulse width of the drive signals outputted from the driver IC6 is set as the reference, and therefore the correction value for correcting the pulse width of the drive signals outputted from the driver IC6 is equal to ±0. (Hereinafter, the driver IC6 may be referred to as "a reference driver IC6.) Compared to the pulse width of the drive signals outputted from the reference driver IC6, the pulse widths of the drive signals outputted respectively from the driver IC5 through the driver IC1 are shorter, in other words, the respective pulse widths of the driver IC5, the driver IC4, the driver IC3, the drive IC2, and the driver IC1 decrease in order. The pulse width of the drive signals outputted from the driver IC1 is the shortest. On the contrary, compared to the pulse width of the drive signals outputted from the reference driver IC6, the pulse widths of the drive signals outputted respectively from the driver IC7 through the driver IC 10 are longer, in other words, the respective pulse widths of the driver IC7, the driver IC8, the driver IC9, the driver IC10, and the driver IC 11 increase in order. The pulse width of the drive signals outputted from the driver IC1 is the longest. Namely, each of the correction values for the respective driver ICs is set so as to correspond to a difference from the pulse width of the drive signals outputted from the reference driver IC6. The absolute values of the correction values increase from |a1| toward |a5|, and |a1| is the smallest while |a5| is the largest.

(e) Adjustment Process

Driver IC information for specifying the identification data of the two driver ICs 80, 81 is indicated at a prescribed place of the ink-jet printer 1 or in the instruction manual, etc. The user of the printer 1 inputs the driver IC information through the host computer 71 or the operation panel 56. Further, the order of performing adjustment of the driver ICs 80, 81 is also inputted through the host computer 71 or the operation panel 56. Here, the adjustment of the driver IC 80 is first performed and thereafter the adjustment of the driver IC 81 is performed.

By referring to the flow chart of FIG. 6, the adjustment process (hereinafter may be referred to as "adjustment process 1") will be explained. Initially, the CPU 57 judges in Step S2 (hereinafter "Step" is omitted) whether the driver IC information is inputted or not. If the CPU 57 judges that the driver IC has been inputted ("Yes" in S2), the CPU 57 refers to the correction table Ta1 (FIG. 5) in S4, reads out, in S6, a correction value which corresponds to identification data that is specified by the inputted driver IC information, and outputs the read correction value to the output circuit 96 in S8. Where the identification data specified by the inputted driver IC information is the driver IC3, for instance, the CPU 57 reads out, from the correction table Ta1, the correction value +a3 that corresponds to the identification data IC3, and outputs data indicative of the read correction value to the output circuit 96.

The output circuit 96 outputs, as an adjust signal, a signal which represents the data indicative of the inputted correction value, to the correction circuit 60*c* of the ejection-signal generating circuit 60 via an interface circuit 83. The correction circuit 60*c* performs, with respect to the setting circuit 60*b*, correction corresponding to the correction value represented by the inputted adjust signal. For instance, where the correction value represented by the adjust signal is +a3, the pulse width Wa of the ejection signals set at the setting circuit 60*b* is adjusted by an amount of +a3. In a case where the setting circuit 60*b* is equipped with a timer for adjusting the pulse width, the set value of the timer is corrected by an amount of +a3. Thus, the pulse width Wb of the drive signals outputted from the driver IC 80 based on the ejection signals outputted from the ejection-signal generating circuit 60 is corrected so as to be equal to the pulse width of the reference drive signal.

Similarly, the driver IC information of the driver IC 81 is inputted, and the pulse width Wa of the ejection signals generated by the ejection-signal generating circuit 61 is adjusted to the pulse width of the reference drive signal, whereby the pulse width Wb of the drive signals to be outputted from the driver IC 81 is corrected. As a result of the adjustment process performed on the driver ICs 80, 81, the variation in the pulse width Wb of the drive signals outputted respectively from the driver ICs 80, 81 can be eliminated.

In this embodiment, an adjusting portion is constituted by including the ROM 43 in which the correction table Ta1 is stored, the output circuit 96, the correction circuit 60*c*, the CPU 57 which executes the adjustment process 1 (FIG. 6). The ROM 43 in which the correction table Ta1 is stored constitutes a storing section. Further, the output circuit 96 constitutes an adjust-signal outputting section.

<Effect of the First Embodiment>

In the ink-jet printer 1 according to the illustrated first embodiment, the pulse widths Wb of the drive signals outputted from the respective driver ICs 80, 81 can be corrected by simply inputting the driver IC information for specifying the identification data of the respective driver ICs 80, 81. Therefore, it is possible to eliminate the variation in the pulse width Wb between the drive signals outputted from the driver IC 80 and the drive signals outputted from the driver IC 81. Consequently, it is possible to eliminate the variation in the volume of the ink droplet to be ejected from the nozzles in the two channel areas which respectively correspond to the two driver ICs 80, 81. Accordingly, there exists no difference in the printing quality of the two print regions respectively corresponding to the two channel areas, thereby improving the printing quality of the ink-jet printer 1.

1-2. Second Embodiment

Figure 9:
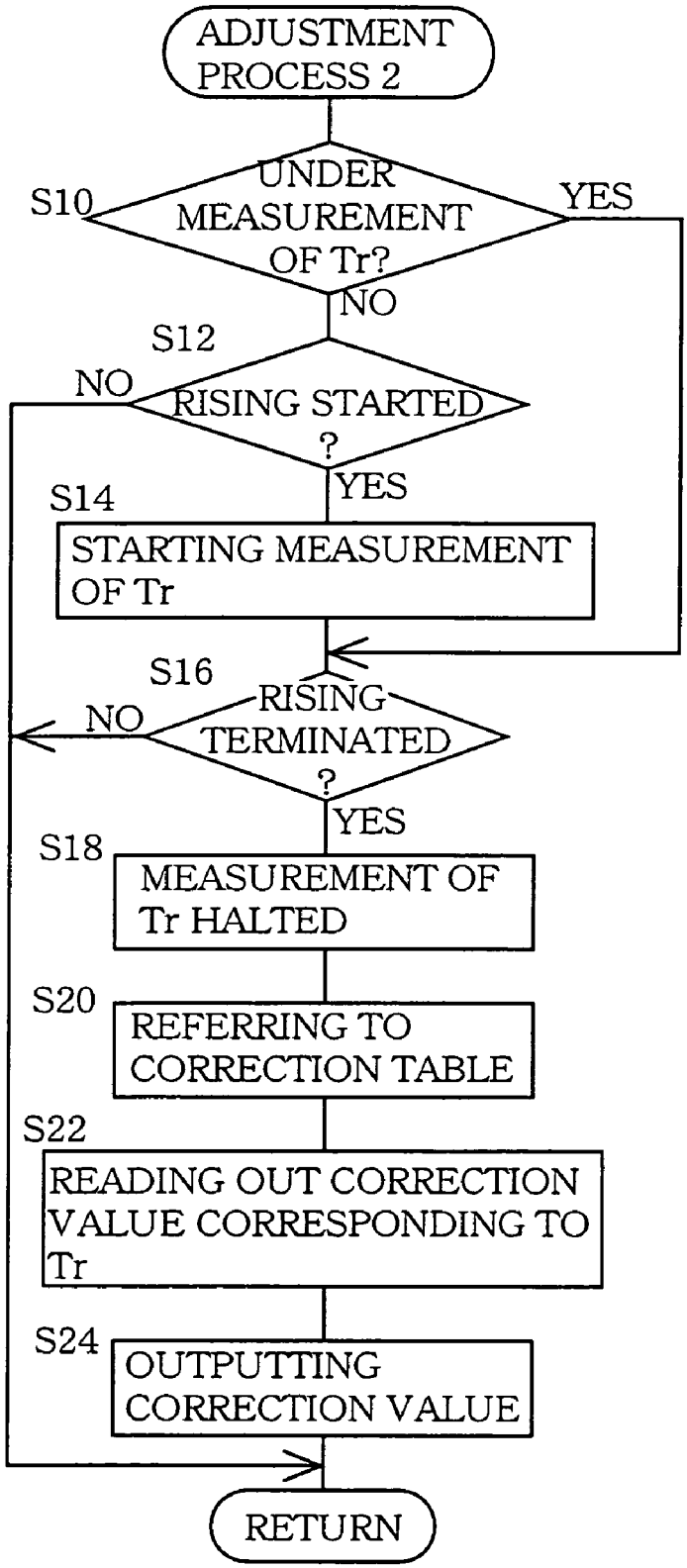
FIG. 9 is a flow chart showing another adjustment process executed by another CPU provided in a measurement device.

By referring next to FIGS. 7-9, there will be explained a second embodiment of the first aspect of the invention. In this second embodiment, the same reference numerals as used in the illustrated first embodiment are used to identify the corresponding components, and a detailed explanation of which is not given. In the ink-jet printer according to the second embodiment, the rise time of the drive signals is actually measured, and the pulse width of the drive signals is adjusted in accordance with the result of measurement. The relationship between the ejection signals and the drive signals, the relationship between the characteristic of the drive signals and the ink-dejection property, and the principal structure of the ejecting-signal generating circuits are similar to those explained with respect to the illustrated first embodiment.

Figure 7:
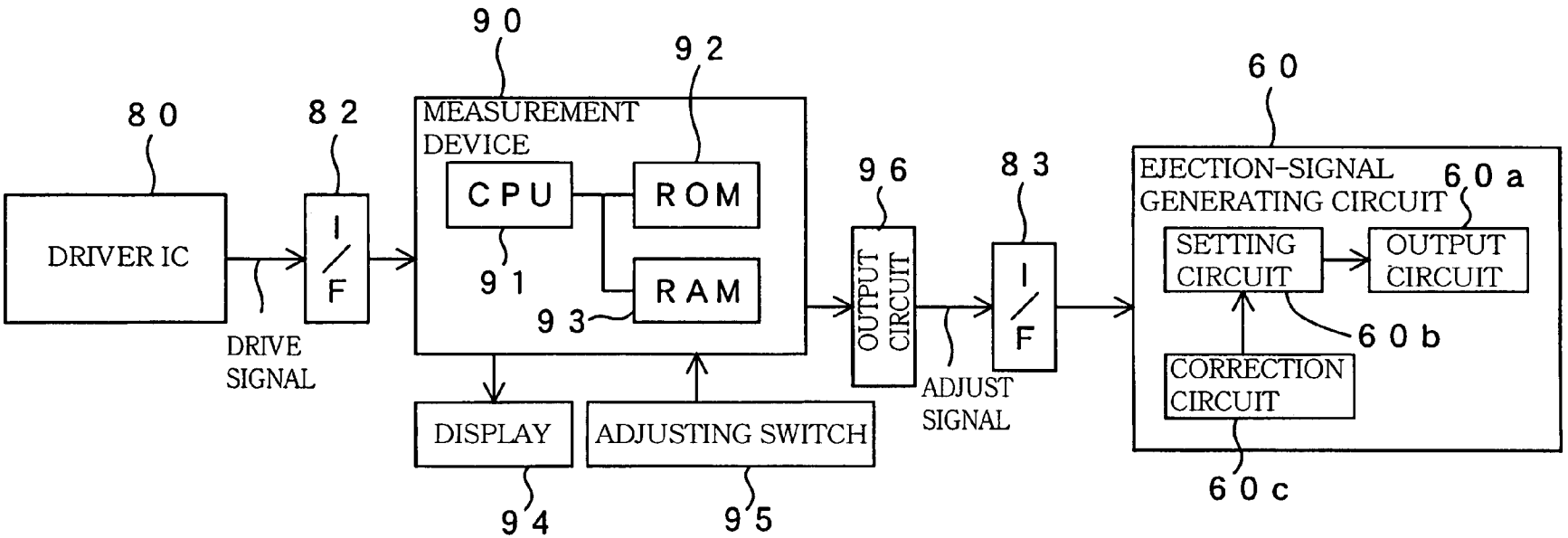
FIG. 7 is a block diagram showing a main electric structure which relates to measurement and adjustment of the pulse width of the drive signal.

FIG. 7 is a block diagram showing main electric structure relating to the measurement and adjustment of the pulse width of the drive signals. FIG. 8 shows structure of a correction table Ta2. FIG. 9 is a flow chart showing adjustment process (hereinafter may be referred to as "adjustment process 2") executed by a CPU provided in a measurement device 90 explained below.

<Principal Structure of Measurement Device>

The measurement device 90 which measures the pulse width Wb of the drive signals outputted from each driver IC 80, 81 includes a CPU 91, a programmable ROM 92 such as EEPROM, and a RAM 93. The CPU 91 executes the adjustment process 2 (which will be described) for outputting a correction value based on the result of measurement. The ROM 92 stores programs for execution of the adjustment process 2 by the CPU 91, the correction table Ta2 shown in FIG. 5, and the like. The RAM 93 temporarily stores the result of operation by the CPU 91. To the measurement device 90, there are electrically connected a display 94 on which the result of measurement is displayed and an adjusting switch 95 used for rewriting the contents stored in the ROM 92.

<Structure of Correction Table>

The correction table Ta2 shown in FIG. 8 is referred to by the CPU 91 for reading out the characteristic data (the correction value) which corresponds to the measured rise time Tr of the drive signals. The correction table Ta2 is configured such that ranges of the rise time Tr of the drive signals outputted from the respective driver ICs 80, 81 and the characteristic data (the correction values) for correcting the pulse width of the ejection signals are related to each other. As described above, because the rise time Tr and the pulse width Wb of the drive signals are in corresponding relationship, the pulse width Wb can be obtained based on the rise time Tr. Further, because the rise time Tr varies from one driver IC to another, the measured rise time Tr is used as the identification data for identifying the driver IC.

In this embodiment, five ranges of the rise time Tr are set, i.e., Tr1≦Tr<Tr2, Tr2≦Tr<Tr3, Tr3≦Tr<Tr4, Tr4≦Tr<Tr5, and Tr5≦Tr<Tr6. These five ranges are related to the respective correction values, i.e., +a2, +a1, ±0, −a1, and −a2. The rise time Tr1 is the shortest and the rise time Tr6 is the longest. The rise time Tr of the reference drive signal used as the reference in correcting the pulse width falls in the range of Tr3≦Tr<Tr4. Accordingly, where the measured rise time Tr is in the range of Tr3≦Tr<Tr4, the measured rise time Tr is considered to be substantially equal to the rise time of the reference drive signal, and therefore the correction value is ±0 in this case.

The correction values +a2, +a1, −a1, and −a2 are values necessary for correcting the pulse width of the drive signals of the driver IC for which the measurement of the rise time is carried out, so as to be equal to the pulse width of the reference drive signal, and the relationship among these correction values is represented by +a1<+a2 and −a1>−a2. Where the measured rise time Tr is in the range of Tr2≦Tr<Tr3, for instance, the correction value is +a1. Namely, since the measured rise time Tr is shorter than the rise time of the reference drive signal and accordingly the pulse width is also shorter, the correction corresponding to the correction value +a1 is performed, thereby increasing the pulse width. On the contrary, where the measured rise time Tr is in the range of Tr4≦Tr<Tr5, the correction value is −a1. That is, the measured rise time Tr is longer than the rise time of the reference drive signal and accordingly the pulse with is also longer. Therefore, the correction corresponding to the correction value −a1 is performed, thereby decreasing the pulse width.

<Adjustment Process>

Referring next to the flow chart of FIG. 9, there will be explained the adjustment process 2 executed by the CPU 91 for adjusting the pulse width of the drive signals. Initially, in S10, the CPU 91 judges whether the rise time Tr of the drive signals outputted from the driver IC 80 via the interface 82 is under measurement. Where the CPU 91 judges that the rise time Tr is not under measurement ("No" in S10), the CPU 91 judges in S12 whether the voltage of the drive signals has begun to rise, i.e., whether the pulse of the drive signals has begun to rise. If it is judged that the pulse has begun to rise ("Yes" in S12), the measurement of the rise time Tr is started in S14. Thereafter, the CPU 91 judges in S16 whether the voltage of the drive signal has become constant, i.e., whether the rising of the pulse has terminated. If it is judged that the rising of the pulse has terminated ("Yes" in S16), the measurement of the rise time Tr is halted in S18. The result of measurement can be viewed through the display 94.

Subsequently, the CPU 91 refers to the correction table Ta2 in S20, reads out in S22 the correction value that corresponds to the range within which the measured rise time Tr falls, and outputs in S24 the read correction value to the output circuit 96. Where the measured rise time Tr falls within the range of Tr1≦Tr<Tr2, for instance, the CPU 91 reads out, from the correction table Ta2, the correction value +a2 which is related to that range, and outputs the read correction value +a2 to the output circuit 96.

The output circuit 96 outputs, as an adjust signal, a signal which represents the data indicative of the correction value inputted thereto, to the correction circuit 60*c* of the ejection-signal generating circuit 60 via the interface circuit 83. As explained in the illustrated first embodiment, the correction circuit 60*c* corrects the pulse width set at the setting circuit 60*b* in accordance with the correction value represented by the adjust signal inputted thereto. Thus, the pulse width of the drive signals to be outputted from the drive IC 80 on the basis of the ejection signals which are outputted from the ejection-signal generating circuit 60 is corrected so as to be equal to the pulse width of the reference drive signal. For the other driver IC 81, the rise time of the drive signals outputted therefrom is similarly measured, and the pulse width of the ejection signals outputted from the ejection-signal generating circuit 61 is corrected. As described above, the rise time of the drive signals outputted from each driver IC 80, 81 is measured, whereby the pulse width of the drive signals can be corrected in accordance with the result of measurement.

In this embodiment, an adjusting portion is constituted by including the ROM 92 in which the correction table Ta2 is stored, the output circuit 96, the correction circuit 60*c*, and the CPU 91 which executes the adjustment process 2. The ROM 92 in which the correction table Ta2 is stored constitutes a storing section. Further, the output circuit 96 constitutes an adjust-signal outputting section and a portion of the measurement device 90 which performs the measurement constitutes a time-measuring section.

<Effect of the Second Embodiment>

As explained above, in the ink-jet printer according to the illustrated second embodiment, the rise times Tr of the drive signals outputted from the driver ICs 80, 81, respectively, are measured, and the pulse widths Wb of the drive signals are corrected in accordance with the result of measurements. Therefore, it is possible to avoid variation in the pulse width Wb among the drive signals to be outputted from the respective two driver ICs 80, 81. Accordingly, it is also possible to avoid variation in the volume of the ink droplet to be outputted from the nozzles in the respective two channel areas which respectively correspond to the two driver ICs 80, 81, whereby the printing quality can be significantly improved. In the illustrated second embodiment, the ranges of the rise time Tr or the correction values of the correction table Ta2 stored in the ROM 92 can be rewritten by operation through the adjusting switch 95. This arrangement enables the contents of the correction table Ta2 to be rewritten even where the relationship between the rise time Tr and the correction value changes due to changes in the specifications of the driver ICs, etc.

1.3 Other Embodiments (1) In a case where the variation exists in the ink-ejection property of the nozzles of the two channel areas which respectively correspond to the two driver ICs 80, 81, the variation in the ink-ejection property can be eliminated by adjusting a number of pulses of the drive signals outputted from each driver IC 80, 81. For instance, where the volume of the ink droplet to be ejected from the nozzles of one of the two channel areas which corresponds to one of the two driver ICs 80, 81 is smaller than the volume of the ink droplet to be ejected from the nozzles of the other of the two channel areas which corresponds to the other of the two driver ICs 80, 81 and therefore there exists a difference in the print concentration between the two print regions corresponding to the two channel areas, the number of pulses of a single drive signal outputted from the above-indicated one of the two driver ICs 80, 81 is increased. According to this arrangement, the number of times of ink ejection by the single drive signal outputted from the above-indicated one driver IC is increased, so that the amount of the ink to be ejected to a position of the recording medium corresponding to one dot print signal is increased. Consequently, the print concentration is increased as in a case where the volume of the ink droplet by one ejection is increased.

For instance, in the correction table Ta1 shown in FIG. 5, the pulse number is set as the correction value which is related to each identification data. Further, the setting circuit 60*b* of the ejection-signal generating circuit 60 is arranged to have a function of setting the pulse number while the correction circuit 60*c* is arranged to have a function of correcting the pulse number set at the setting circuit 60*b*, in accordance with the correction value represented by the inputted adjust signal. According to this arrangement, the pulse number of the drive signals can be corrected by simply inputting the driver IC information, so that it is possible to avoid the difference in the print concentration between the two print regions respectively corresponding to the two channel areas, due to the variation in the volume of the ink droplet existing between the two driver ICs.

Described more specifically, a pulse P2 is added to a pulse P1 of the original ejection signal as shown in FIG. 3B, for instance. Accordingly, the ink is ejected two times corresponding to the pulses P1, P2. The volume of the ink droplet at the time of the second ink ejection changes depending upon the pulse width of the pulse P2 as in the pulse P1. The adjustment of the pulse number described above is effective when the difference in the print concentration cannot be corrected or eliminated simply by adjusting the pulse width of the drive signals.

(2) In a case where the variation exists in the ink-ejection property of the nozzles of the two channel areas which respectively correspond to the two driver ICs 80, 81, the variation in the ink-ejection property can be eliminated by adjusting the voltage of the drive signals outputted from each driver IC, to a predetermined voltage. Where the ink-ejecting speed in one of the two channel areas corresponding to one of the two driver ICs is lower than the ink-ejecting speed in the other of the two channel areas corresponding to the other of the two driver ICs and therefore there exists a difference in resolution of the printed images due to a difference in the attaching position to which the ink droplet attaches, between the two print regions which respectively correspond to the two channel areas, the voltage of the drive signals outputted from the above-indicated one of the two driver ICs is increased. According to this arrangement, the ink-ejecting speed in the above-indicated one channel area corresponding to the above-indicated one driver IC is increased, thereby eliminating the difference in the ink-ejecting speed between the two channel areas.

For instance, in the correction table Ta1 shown in FIG. 5, the voltage is set as the correction value which is related to each identification data. Further, the setting circuit 60*b* of the ejection-signal generating circuit 60 is arranged to have a function of setting the voltage while the correction circuit 60*c* is arranged to have a function of correcting the voltage set at the setting circuit 60*b*, in accordance with the correction value represented by the inputted adjust signal. According to this arrangement, the voltage of the drive signals can be corrected by simply inputting the driver IC information, so that it is possible to avoid the difference in the resolution of the printed images between the two print regions respectively corresponding to the two channel areas, due to the variation in the ink-ejecting speed existing between the two driver ICs.

(3) In the illustrated second embodiment, the rise time Tr of the drive signals is measured. The fall time Tf of the drive signals may be measured and the pulse width of the ejection signals may be corrected in accordance with the result of measurement, thereby correcting the pulse width of the drive signals.

2. Embodiments of the Second Aspect

Figure 10:
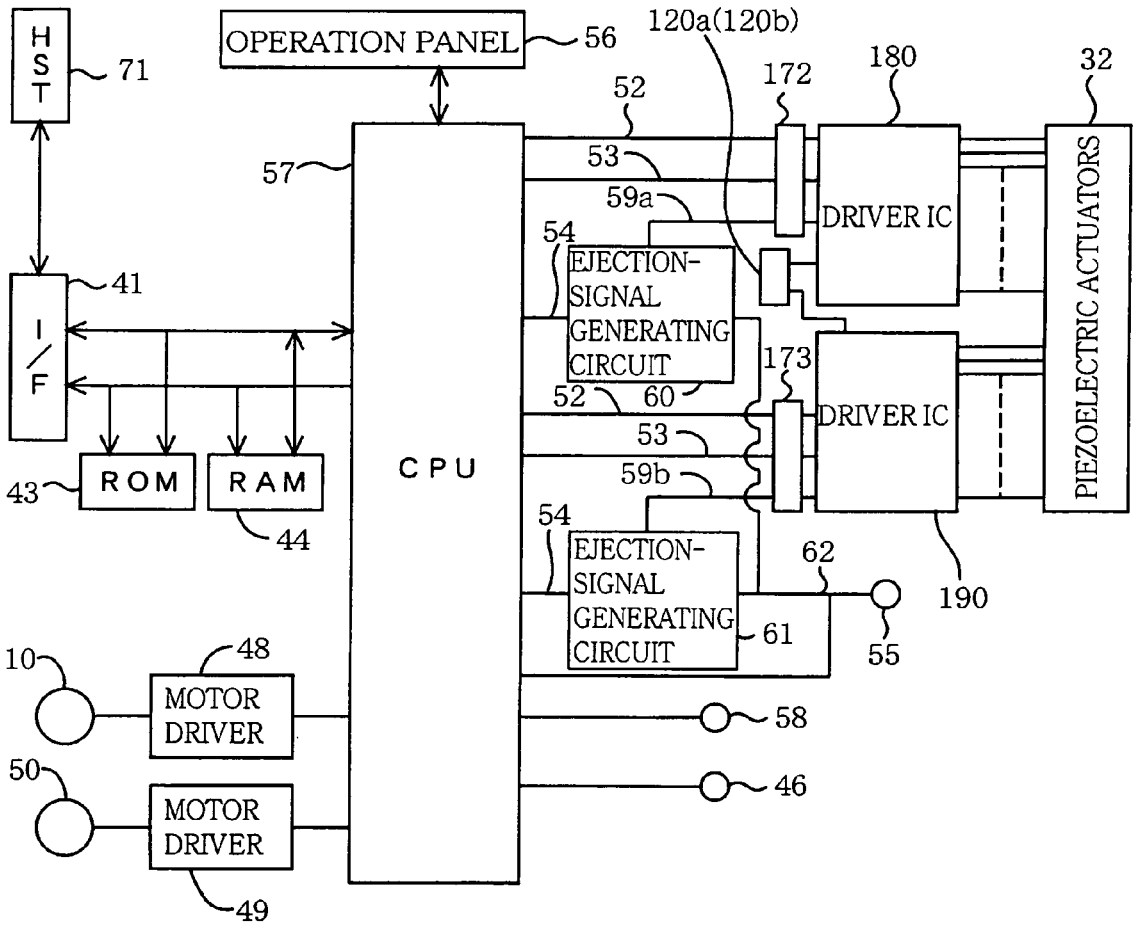
FIG. 10 is a block diagram showing principal parts of a control system of the ink-jet printer of FIG. 1, according to embodiments of the second aspect of the invention.

There will be next described embodiments according to the second aspect of the invention. In the embodiments according to the second aspect, the principal structure of the ink-jet printer is the same as that explained in the embodiments according to the first aspect. Further, the principal structure of the control system is the same as that explained in the embodiments according to the first aspect, except that resistor circuits 120*a*, 120*b* and interfaces 172, 173 are additionally provided as shown in FIG. 10.

2-1. First Embodiment

Explanation of Structure

Referring first to the block diagram of FIG. 11A, there will be explained principal structure of two driver ICs 180, 190 according to the first embodiment of the second aspect. The ink-jet head unit 30 is driven by the two driver ICs 180, 190 each as a drive circuit. First, the structure and operation of the driver IC 180 will be described.

Figure 11A:
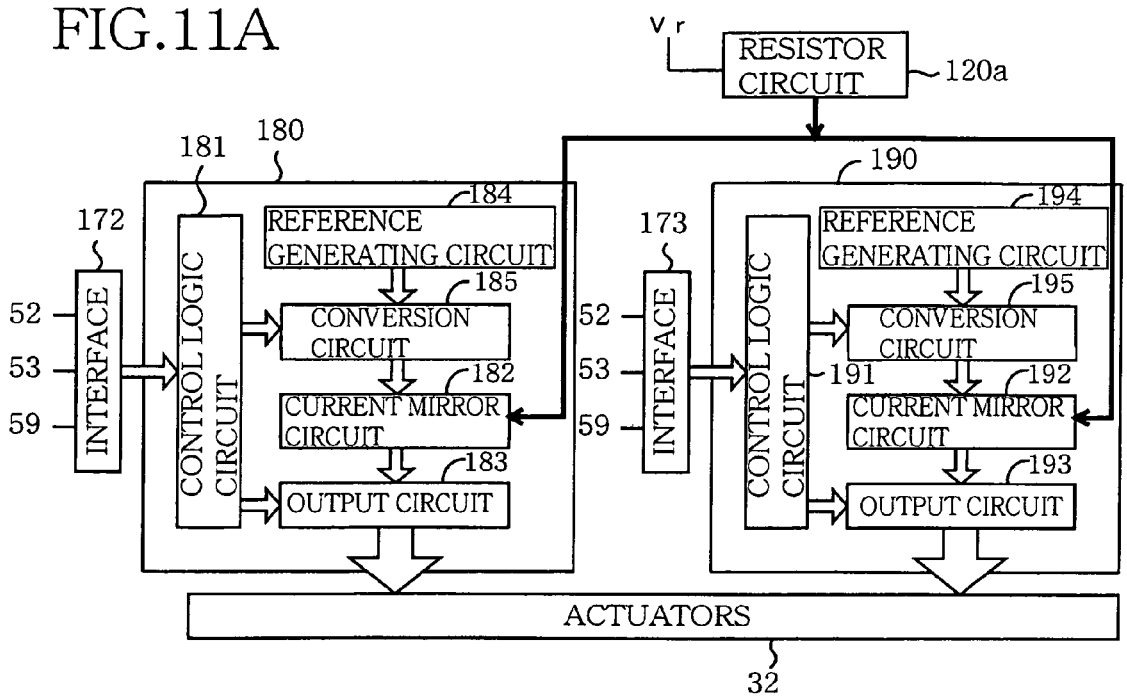

As shown in FIG. 11A, the driver IC 180 includes a control logic circuit 181, a reference generating circuit 184, a conversion circuit 185, a current mirror circuit 182, and an output circuit 183. The control logic circuit 181 includes: a serial-parallel conversion circuit which sequentially takes in a serial dot print signal 52 from the CPU 57 in synchronism with a transfer clock signal 53 (FIG. 10) outputted from the CPU 57 and converts the serial dot print signal into a parallel dot print signal; a latch circuit which latches the dot print signal outputted from the serial-parallel conversion circuit; and AND circuits provided on the output side of the latch circuit so as to correspond to respective channels. When the dot print signals outputted from the serial-parallel circuit for the respective channels and the ejection signals 59*a* outputted from the ejection-signal generating circuit 60 are inputted to the respective AND circuits, the logical product is equal to 1 and consequently the AND circuits respectively output ejection signals corresponding to the print data to the output circuit 183.

The reference generating circuit 184 generates a reference voltage in the driver IC 80. The conversion circuit 185 converts the reference voltage generated by the reference generating circuit 184 into a reference current. The current mirror circuit 82 is for distributing a signal indicative of the reference current outputted from the conversion circuit 185, to each channel. The output circuit 183 includes a current amplifier which is provided for each channel and which amplifies the reference current supplied from the current mirror circuit 182 for forming drive signals in which a pulse thereof has a waveform having a suitable leading edge and trailing edge. The output circuit 183 operates based on the ejection signals outputted from the control logic circuit 181 and outputs a drive signal to each of the actuators corresponding to each of the channels which are controlled by the driver IC 80. Namely, in each AND circuit of the control logic circuit 181, where the logical product determined by the dot print signal and the ejection signal 59 is equal to 1, the output circuit 183 outputs the current-amplified ejection signal as a drive signal for actually driving an actuator which corresponds to the current-amplified ejection signal. On the other hand, where the logical product is equal to 0, the current-amplified ejection signal is not outputted from the output circuit 183. Where the reference voltage generated by the reference generating circuit 184 or the reference current outputted from the conversion circuit 185 changes, the voltage value or the current value of the drive signals outputted from the output circuit 183 also changes, that is, the energy of the drive signals also changes. Accordingly, it is possible to detect a change in the reference voltage or the reference current as a change in the energy of the drive signals.

The driver IC 190 includes a control logic circuit 191, a current mirror circuit 192, an output circuit 193, a reference generating circuit 194, and a conversion circuit 195. These circuits 191, 192, 193, 194, 195 operates in a manner similar to the corresponding circuits 181, 182, 183, 184, 185 of the driver IC 180. The output circuit 193 outputs a drive signal to each of the actuators corresponding to each of the channels which are controlled by the driver IC 190.

In this embodiment, a resistor circuit 120*a* is electrically connected in common to the current mirror circuit 182 of the driver IC 180 and the current mirror circuit 192 of the driver IC 190. The resistor circuit 120*a* generates a constant current based on the a power source Vr and outputs the constant current to current input sides of the respective current mirror circuits 182, 192. Accordingly, the constant current outputted from the resistor circuit 20*a* is inputted to the respective current mirror circuits 182, 192, in place of the current outputted from the respective conversion circuits 185, 195, whereby the rise time Tr and the fall time Tf of the drive signals to be outputted from the output circuit 183 and those of the drive signals to be outputted from the output circuit 193 can be conformed to each other. The rise time Tr and the fall time Tf of the drive signals to be outputted from each output circuit 183, 193 can be adjusted by adjusting the resistance of the resistor circuit 120*a* and thereby adjusting the current value inputted to each current mirror circuit 182, 192, i.e., the current value of the drive signals to be outputted from each output circuit 183, 193.

The resistance value of the resistor circuit 120*a* is determined on the basis of the rise time Tr and the fall time Tf of the drive signals to be outputted from each driver IC 180, 190. Thus, the resistor circuit 120*a* connected to the power source Vr functions as an adjusting portion that is constituted by including a reference-signal outputting section which outputs a common reference signal in the form of the constant current for conforming the characteristic of the drive signals to be outputted from the driver IC 180 and the characteristic of the drive signals to be outputted from the driver IC 190 to each other and which includes an electronic circuit that fixes physical quantity which specifies the signal.

<Effect of the First Embodiment>

(1) In the ink-jet printer constructed as described above wherein the resistor circuit 120*a* disposed outside of the driver ICs 180, 190 is connected to the current mirror circuits 182, 192 of the respective driver ICs 180, 190, the output characteristics of the respective current mirror circuits 82, 92 are controlled by the resistor circuit 120*a* connected in common to the current mirror circuits 182, 192. Hence, the rise time Tr and the fall time Tf of the drive signals to be outputted from the driver IC 180 and those of the drive signals to be outputted from the driver IC 190 can be conformed to each other. Therefore, this arrangement eliminates the difference in the printing quality between the two print regions respectively corresponding to the two channel areas which are controlled by the respective two driver ICs 180, 190, thereby enhancing the printing quality of the entire print region of the recording medium.

(2) The variation in the drive signals to be outputted from the respective driver ICs 180, 190 can be eliminated with simple measures, i.e, the resistor circuit 120*a*, so that the circuitry structure for adjusting the drive signals can be simplified and the cost required for adjusting the drive signals can be reduced.

(3) In the present embodiment, the reference generating circuits 184, 194 for generating the reference voltage and the conversion circuits 185, 195 for generating the reference current from the reference voltage are not used. Hence, it does not matter if the accuracy or precision required by those circuits is low. Alternatively, those circuits may be dispensed with. In other words, the ink-jet printer can employ relatively inexpensive driver ICs 180, 190, and the degree of freedom in the circuitry structure can be increased while decreasing the cost of the control system.

<Modified Arrangements>

Figure 11B:
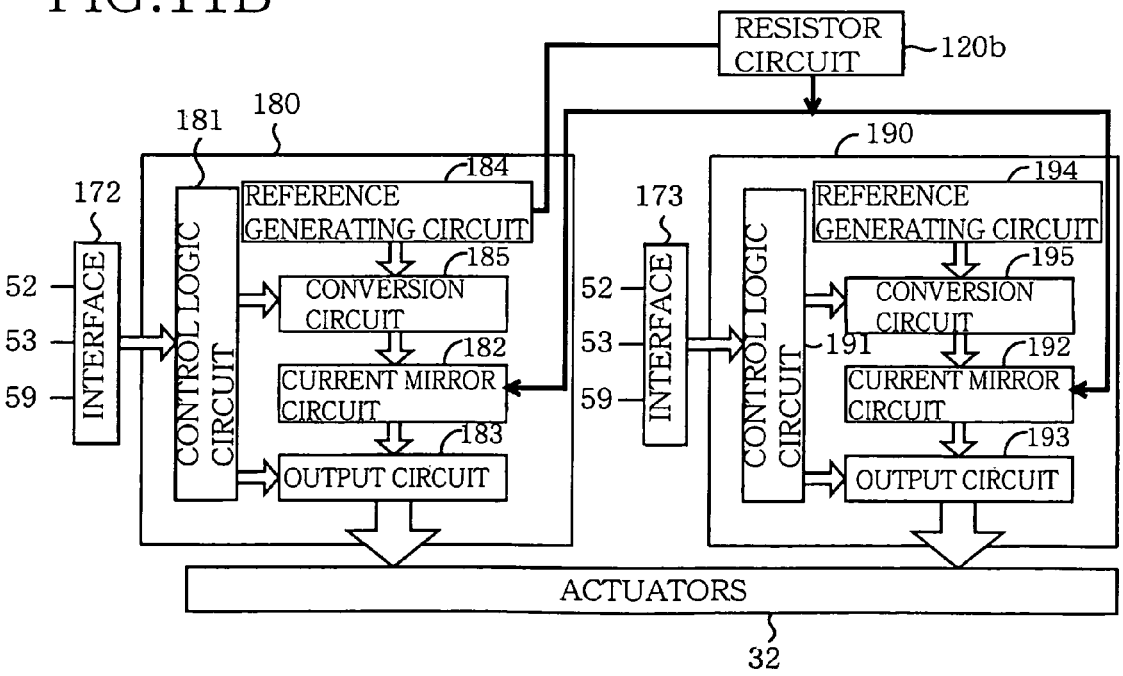

(1) Either one of the reference generating circuits 184, 194 of the driver ICs 180, 190 may be connected to a resistor circuit and the resistor circuit may be connected in common to the current mirror circuits 182, 192 of the respective driver ICs 180, 190. In this modified arrangement as shown in FIG. 11B, the reference generating circuit 184 of the driver IC 180 is connected to a resistor circuit 120*b* and functions as a common power source for outputting the reference voltage. According to this arrangement, the resistor circuit 120*b* generates a constant current that corresponds to the reference voltage outputted from the reference generating circuit 184 and outputs the constant current to the current mirror circuits 182, 192 to which the resistor circuit 120*b* is connected in common. In this modified arrangement, one of the reference generating circuits 184, 194 and the conversion circuits 185, 194 for generating the reference current from the reference voltage are not used, thereby increasing the degree of freedom in the circuitry structure and contributing to reduction in the cost of the control system. The resistor circuit 120*b* may be connected in common to the conversion circuits 185, 195 of the respective driver ICs 180, 190, and the reference current outputted from the conversion circuit 185 and the reference current outputted from the conversion circuit 195 may be made identical to each other. These arrangements also enjoy the effects (1) and (2) described above with respect to the illustrated first embodiment. Further, these arrangements also enjoy an effect similar to the effect (3) of the illustrated first embodiment to some extent.

(2) In place of the resistor circuit 120*a* or the resistor circuit 120*b*, a voltage-adjustable power source may be connected in common to the driver ICs 180, 190. In this arrangement, the current value of the drive signals to be outputted from each driver IC 180, 190 can be adjusted by adjusting the power source, so that this arrangement enjoys an effect that the rise time Tr and the fall time Tf of the drive signals can be adjusted, in addition to the effects (1)-(3) described above with respect to the illustrated first embodiment. The power source may be connected to the reference generating circuits 184, 194 or the conversion circuits 185, 195.

(3) Any suitable components other than the resistor circuit and the power source described above may be connected in common to the driver ICs 180, 190, as long as the characteristic of the drive signals to be outputted from the driver IC 180 and the characteristic of the drive signals to be outputted from the driver IC 190 can be conformed to each other.

(4) In the illustrated first embodiment and modified arrangements thereof, the resistor circuit 120*a* or the resistor circuit 120*b* functions as the adjusting portion. For conforming the characteristics of the drive signals to be outputted from the respective driver ICs 180, 190 to each other, the adjusting portion is not limited to the resistor circuits 120*a*, 120*b*. As the adjusting portion, there may be employed a constant current circuit utilizing N-channel JFET or P-channel JFET which makes a current flowing in one direction to be a constant value, a bias circuit utilizing transistors, a constant voltage circuit utilizing zener diode or electronic elements analogous to that, a current mirror circuit utilizing transistors, and an electronic circuit which is combined with any of those circuits.

2-2. Second Embodiment

Explanation of Structure

Figure 12A:
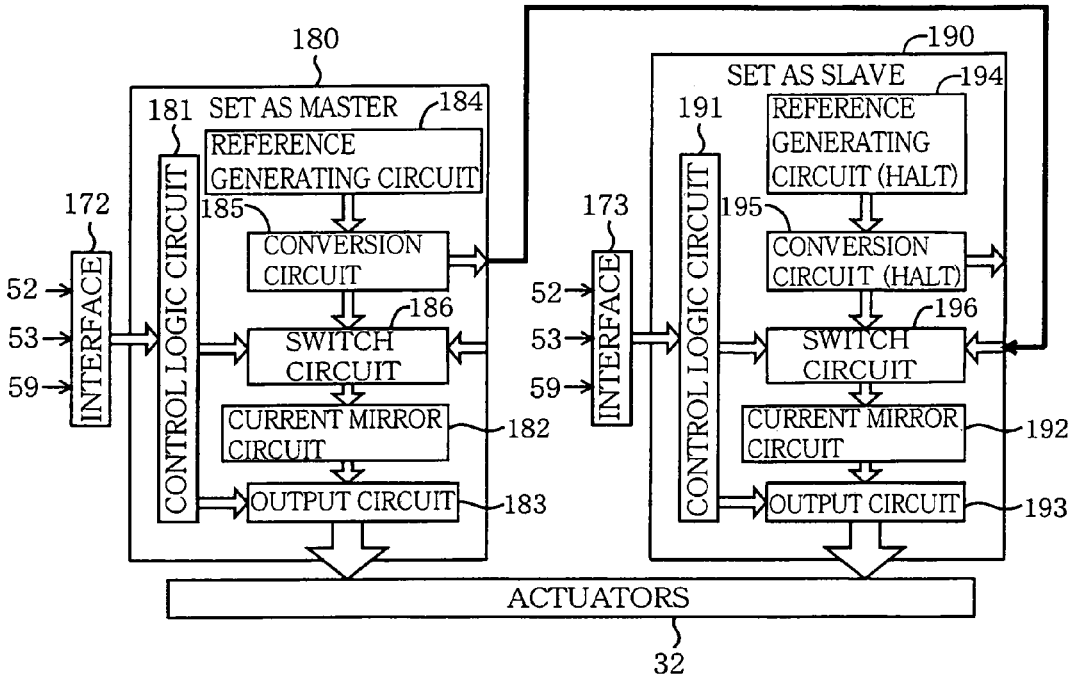

Referring next to FIG. 12A, there will be explained the second embodiment of the second aspect of the invention. In the ink-jet printer according to this second embodiment, one of the two driver ICs 180, 190 is set as a master driver IC (hereinafter may be simply referred to as "the master") and the other of the two driver ICs 180, 190 is set as a slave driver IC (hereinafter may be simply referred to as "the slave"), and the characteristic of the drive signals to be outputted from the slave can be converted into the characteristic of the drive signals to be outputted from the master. In this embodiment, the explanation of the structure and function of the ink-jet printer which are similar to those of the ink-jet printer according to the illustrated first embodiment is not given for the interest of brevity. Further, the same reference numerals as used in the first embodiment are used to identify the corresponding components.

As shown in the block diagram of FIG. 12A indicating principal structure of the driver ICs 180, 190 according to the second embodiment, switch circuits 186, 196 are connected respectively to the output sides of the conversion circuits 185, 195 of the driver ICs 180, 190. Each of the driver ICs 180, 190 is equipped with a register (not shown) which stores setting data for setting itself as the master or the slave. A setting signal which indicates the setting data is inputted to each of the driver ICs 180, 190 such that the setting signal is attached to a top or an end of each ejection signal 59*a*, 59*b* outputted from the ejection-signal generating circuit 60, 61 (FIG. 10), and the setting data indicated by the setting signal is stored in each of the registers. Here, the driver IC 180 is set as the master while the driver IC 190 is set as the slave.

When the ejection signal 59*a* is inputted to the driver IC 180 from the ejection-signal generating circuit 60, the driver IC 180 judges itself as the master on the basis of the setting data stored in the register thereof, whereby the conversion circuit 185 outputs, to the switch circuit 196 of the driver IC 190, the reference current generated by the reference generating circuit 184.

When the ejection signal 59*b* is inputted to the driver IC 190 from the ejection-signal generating circuit 61, the driver IC 190 judges itself as the slave on the basis of the setting data stored in the register thereof, whereby the operation of the reference generating circuit 194 and the conversion circuit 195 is halted when the reference current outputted from the driver IC 180 is inputted to the switch circuit 196. The switch circuit 196 outputs the reference current inputted thereto from the driver IC 180 to the current mirror circuit 192, in place of the reference current which has been outputted from the conversion circuit 195. That is, the driver IC 180 is set as the master while the driver IC 190 is set as the slave, and the driver IC 190 generates drive signals based on the reference current which is identical to that of the driver IC 180. Accordingly, in this embodiment, it is possible to eliminate variation in the rise time Tr and the fall time Tf of the drive signals between the driver IC 180 and the driver IC 190, which variation arises from variation in the reference current between the two driver ICs 180, 190. In this embodiment, the driver ICs 180, 190 are set in advance as one and the other of the master and the slave, depending upon the locations at which the driver ICs 180, 190 are respectively disposed, and the ejection signals 59*a*, 59*b* which correspond to one and the other of the master and the slaves are outputted from the respective ejection-signal generating circuits 60, 61. Namely, in this embodiment, the ejection signal 59*a* is outputted from the ejection-signal generating circuit 60 such that the driver IC 180 connected to the ejection-signal generating circuit 60 always functions as the master.

In this second embodiment, the switch circuits 186, 196 function as an adjusting portion. Further, the adjusting portion is also provided by respective structure of the driver ICs 180, 190 to set themselves respectively as the master and the slave and to switch the reference current which has been outputted from the conversion circuit 195 into the reference current outputted from the driver IC 180. The reference current outputted from the conversion circuit 185 of the driver IC 180 to the switch circuit 196 of the driver IC 190 is a reference signal. The ejection-signal generating circuit 60 functions as a setting-signal outputting section. The driver IC 180 is one of the plurality of drive circuits while the driver IC 190 is the other of the plurality of drive circuits.

<Effect of the Second Embodiment>

(1) In the ink-jet printer constructed according to the illustrated second embodiment, the reference current is outputted from the conversion circuit 185 of the driver IC 180 set as the master to the switch circuit 196 of the driver IC 190 set as the slave, whereby the reference current to be inputted to the current mirror circuit 192 of the driver IC 190 is switched to the reference current inputted into the current mirror circuit 182 of the driver IC 180. Accordingly, the rise time Tr and the fall time Tf of the drive signals to be outputted from the driver IC 180 and the rise time Tr and the fall time Tf of the drive signals to be outputted from the driver IC 190 can be conformed to one another. Therefore, this arrangement eliminates the difference in the printing quality between the two print regions respectively corresponding to the two channel areas which are controlled by the respective two driver ICs 180, 190, thereby enhancing the printing quality of the entire print region of the recording medium.

(2) The driver IC 190 set as the slave has the switch circuit 196 which switches the reference current to be used by the driver IC 190 itself to the reference current outputted from the driver IC 180 set as the master, thereby omitting a step of connecting, to each driver IC 180, 190, an additional circuit for adjusting the characteristics of the driver signals to be outputted from the respective driver ICs 180, 190.

<Modified Arrangements>

(1) In the illustrated second embodiment, the setting of the driver ICs 180, 190 as one and the other of the master and the slave is performed by employing the software technique in which the setting data used for setting the driver ICs 180, 190 as one and the other of the master and the slave is stored in the registers of the respective driver ICs 180, 190. The setting may be performed by employing a hardware technique in which each of the driver ICs 180, 190 is equipped with switching means such as a solder point or a switch which enables the driver ICs 180, 190 to be switched between the master and the slave. This modified arrangement also enjoys the effects (1) and (2) described above with respect to the illustrated second embodiment.

Figure 12B:
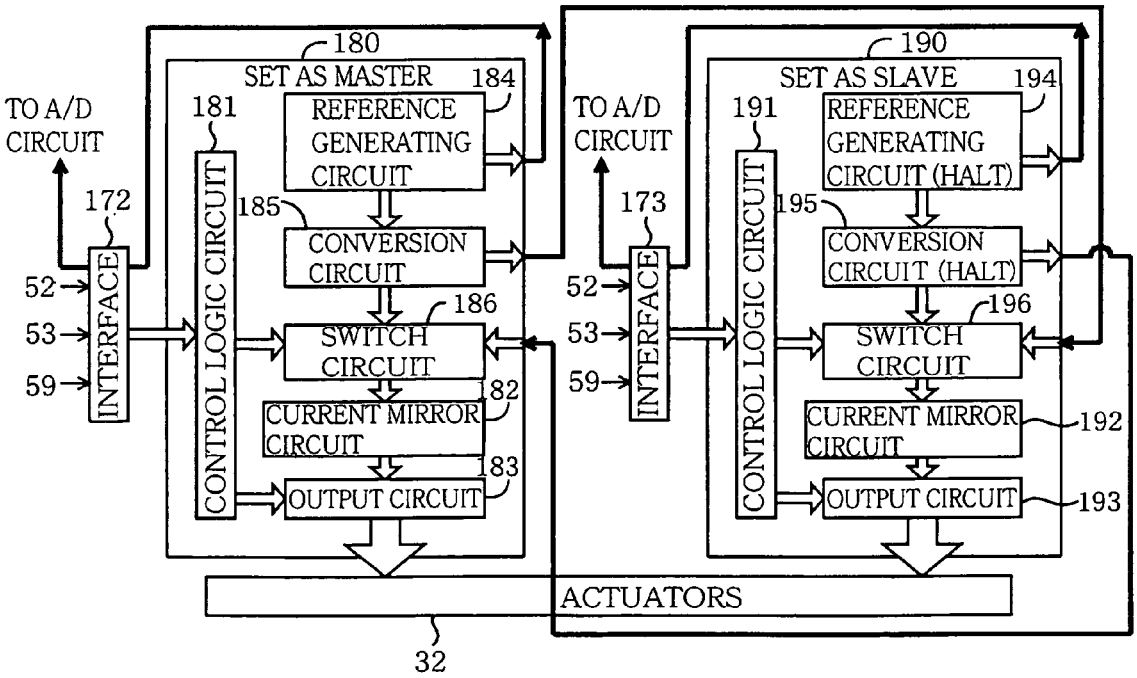

(2) In the illustrated second embodiment, the driver IC which is in a predetermined electric connection relation is arranged to always function as the master, irrespective of the output characteristics of the driver ICs to be used. The master may be selected or determined depending upon the output characteristics of the driver ICs. For instance, as shown in FIG. 12B, A/D conversion circuits (not shown) are connected respectively to output sides of the reference generating circuits 184, 194 of the respective driver ICs 180, 190 via respective interfaces 172, 173, for enabling the output characteristics of the reference generating circuits 184, 194 of the respective driver ICs 180, 190 to be distinguished. The output signals from the respective reference generating circuits 184, 194 are converted by the respective A/D conversion circuits and are sorted according to a predetermined rule. Based on the result of sorting, one of the driver ICs 180, 190 is set as the master. The process of sorting the converted output signals is carried out by the CPU 57 based on rule data stored in advance in the ROM 43. Thereafter, the driver IC sorted as the slave halts the operation of the reference generating circuit and the conversion circuit thereof by the switch circuit thereof. Thus, this arrangement permits the setting of the master and the slave to accurately reflect the output characteristics of the respective driver ICs 180, 190 with respect to desired characteristics. In the arrangement shown in FIG. 12B, the conversion circuit of one of the driver ICs 180, 190 is connected to the switch circuit of the other of the driver ICs 180, 190 while the conversion circuit of the other of the driver ICs 180, 190 is connected to the switch circuit of the one of the driver ICs 180, 190, for enabling either of the driver ICs 180, 190 to be set as either of the master and the slave.

2-3. Third Embodiment

Explanation of Structure

By referring next to FIG. 13A, there will be explained a third embodiment of the second aspect. In the ink-jet printer according to the third embodiment, the characteristic of the drive signals to be outputted from the slave can be converted into the characteristic of the drive signals to be outputted from the master, by setting one of the driver ICs whose reference voltage is maximum or minimum as an effective master and the other of the driver ICs as an effective slave. In this third embodiment, the explanation of the structure and function of the ink-jet printer which are similar to those of the ink-jet printer according to the illustrated first embodiment is not given for the interest of brevity. Further, the same reference numerals as used in the first embodiment are used to identify the corresponding components.

Figure 13A:
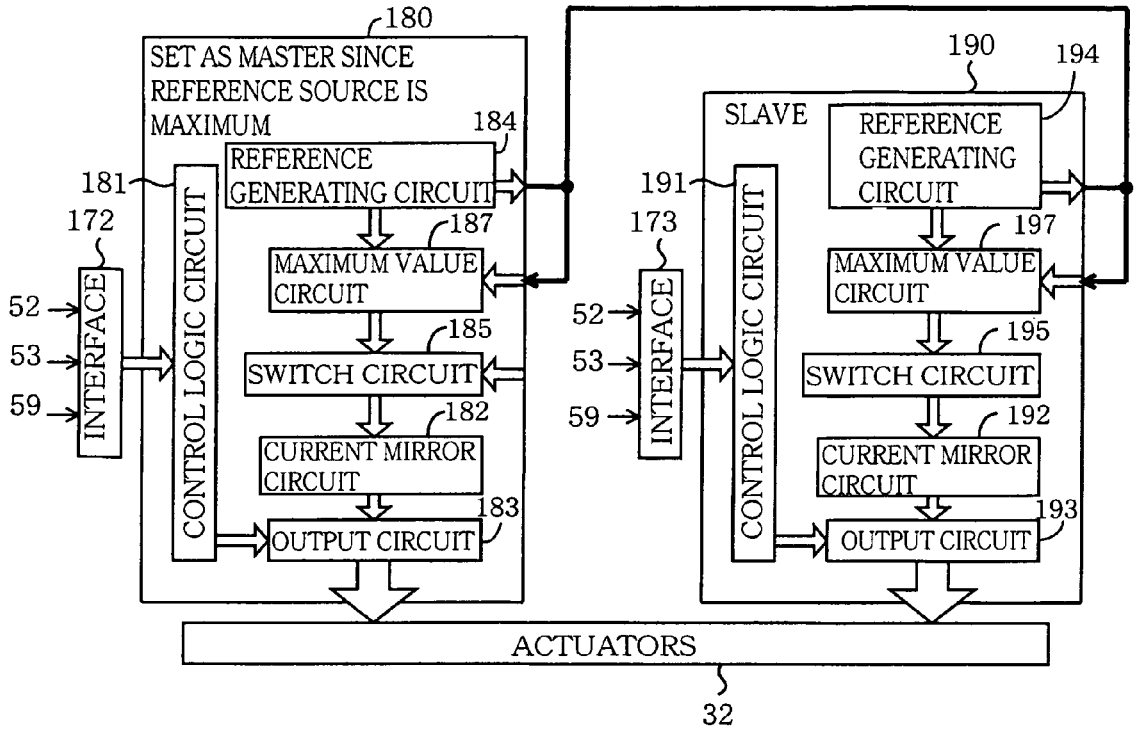

As shown in the block diagram of FIG. 13A indicating principal structure of the driver ICs 180, 190 according to the third embodiment, the driver ICs 180, 190 have maximum value circuits 187, 197, respectively. Where the input voltage of a signal (as a setting signal) inputted from an external to each maximum value circuit is higher than the input voltage thereof, the maximum value circuit converts the input voltage thereof into the higher voltage inputted from the external. In the present embodiment, each of the reference voltages outputted respectively from the reference generating circuits 184, 194 of the respective driver ICs 180, 190 is inputted to each of the maximum value circuits 184, 194 of the respective driver ICs 180, 190. Here, the reference voltage generated by the reference generating circuit 184 of the driver IC 180 is higher than that generated by the reference generating circuit 194 of the driver IC 190.

In the third exemplary embodiment, all of the reference generating circuits 184, 194 are connected to each other. Therefore, though the reference generating circuits 184, 194 output the respective reference voltages which correspond respectively to the characteristics of the individual driver ICs 180, 190, a maximum one of the reference voltages is applied in common to all of the maximum value circuits 187, 197. Because, in the driver IC 180 in which the maximum reference voltage is outputted, the reference voltage outputted from its reference generating circuit 184 is the same as the reference voltage inputted from an external, the reference voltage outputted from the generating circuit 184 is outputted to the conversion circuit 185. In this case, the driver IC 180 is an effective master.

On the other hand, because, in the driver IC 190, the reference voltage inputted from an external, i.e., from the driver IC 180, is higher than the reference voltage outputted from its reference generating circuit 194, the maximum value circuit 197 converts the reference voltage outputted from the reference generating circuit 194 into the reference voltage inputted from the external (i.e., from the driver IC 180), namely, into the reference voltage outputted from the driver IC 180 as the effective master, and outputs that higher reference voltage to the conversion circuit 195. In other words, where the reference voltages which are respectively outputted from the reference generating circuits of the respective driver ICs are mutually different, the lower one of the reference voltages can be converted into the higher one of the reference voltages. Therefore, this arrangement eliminates the variation in the rise time Tr and the fall time Tf of the drive signals to be outputted from the respective driver ICs, which variation is due to the variation in the reference voltage between the driver ICs.

In this third embodiment, the maximum value circuits 187, 197 function as an adjusting portion. Further, the adjusting portion is also provided by respective structure of the driver ICs 180, 190 to set themselves respectively as one and the other of the master and the slave and to convert the reference voltage generated by the reference generating circuit 194 of the driver IC 190 into the reference voltage generated by the reference generating circuit 184. The reference voltage outputted from the reference generating circuit 184 of the driver IC 180 to the maximum value circuit 197 of the driver IC 190 is a reference signal. The reference generating circuit 184 of the driver IC 180 functions as a setting-signal outputting section. The driver IC 180 is one of the plurality of drive circuits which outputs the drive signals having maximum energy.

<Effect of the Third Embodiment>

(1) In the ink-jet printer according to the illustrated third embodiment, the driver IC 180 whose reference voltage is higher is set as the master and the reference voltage of the driver IC 190 set as the slave is converted into the reference voltage of the driver IC 180 as the master. Accordingly, the rise time Tr and the fall time Tf of the drive signals to be outputted from the driver IC 180 and those of the drive signals to be outputted from the driver IC 190 can be conformed to one another. Therefore, this arrangement eliminates the difference in the printing quality between the two print regions respectively corresponding to the two channel areas which are controlled by the respective two driver ICs 180, 190, thereby enhancing the printing quality of the entire print region of the recording medium.

(2) Because the driver IC 190 set as the slave is equipped with the maximum value circuit which converts the reference voltage to be used by the driver IC 190 itself into the reference voltage outputted from the driver IC 180 set as the master, thereby omitting a step of connecting, to each driver IC 180, 190, an additional circuit for adjusting the characteristics of the driver signals to be outputted from the respective driver ICs 180, 190.

<Modified Arrangements>

Figure 13B:
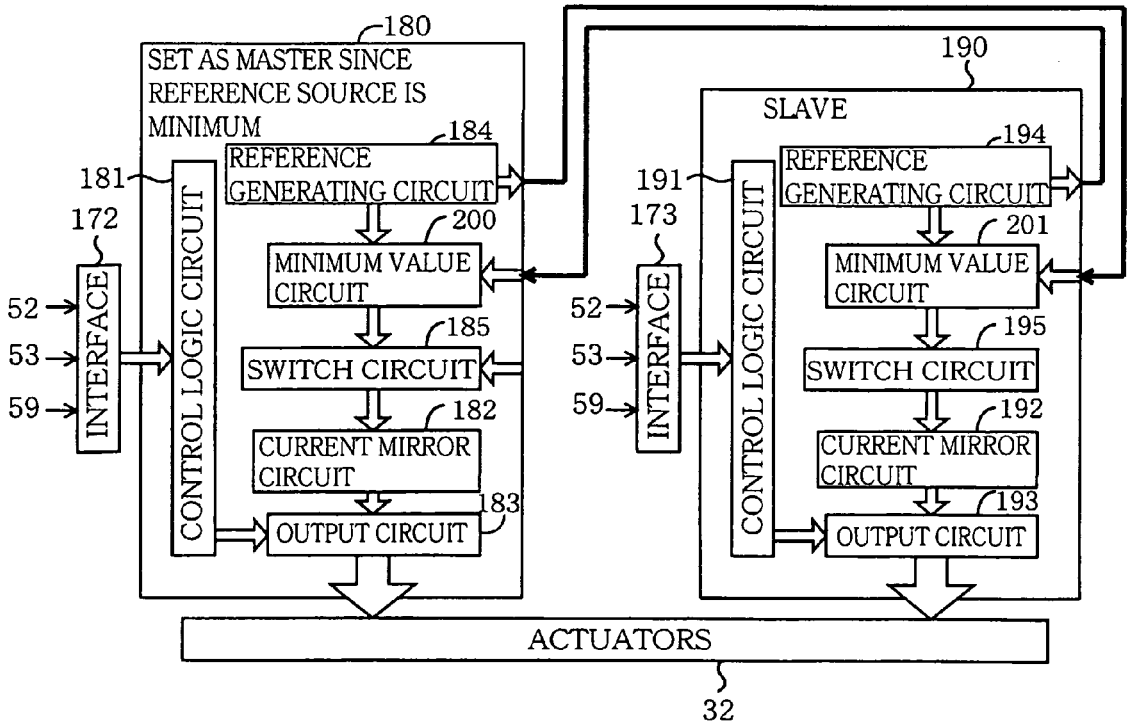
Figure 14A:
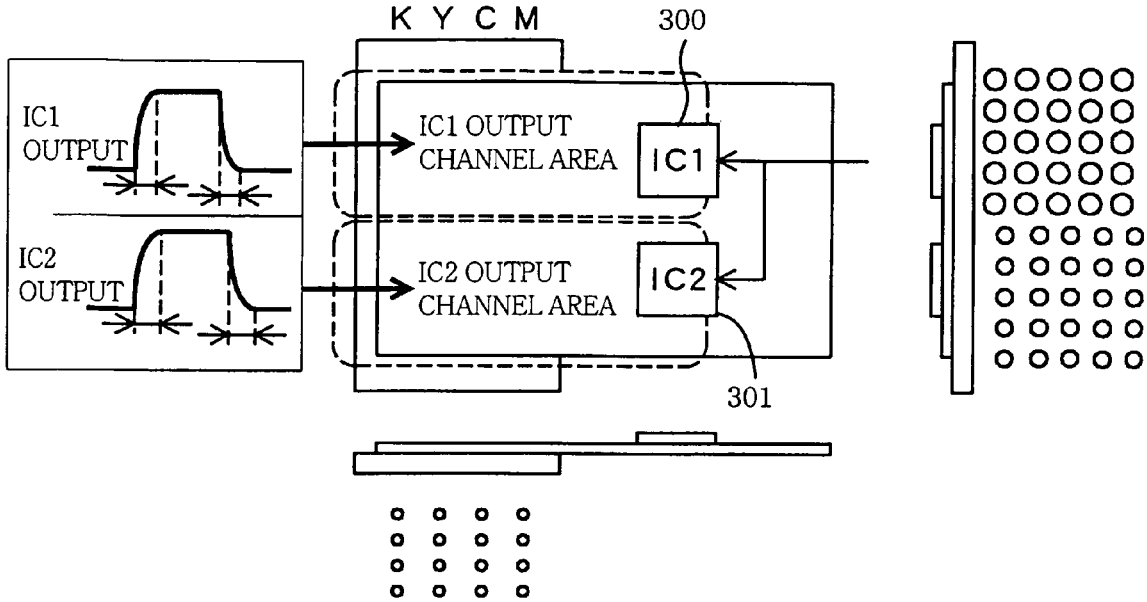
FIG. 14A is a view for explaining an ink-jet head provided with two driver ICs and FIG. 14B is a view for explaining drive signals outputted respectively from the two driver ICs.
Figure 14B:
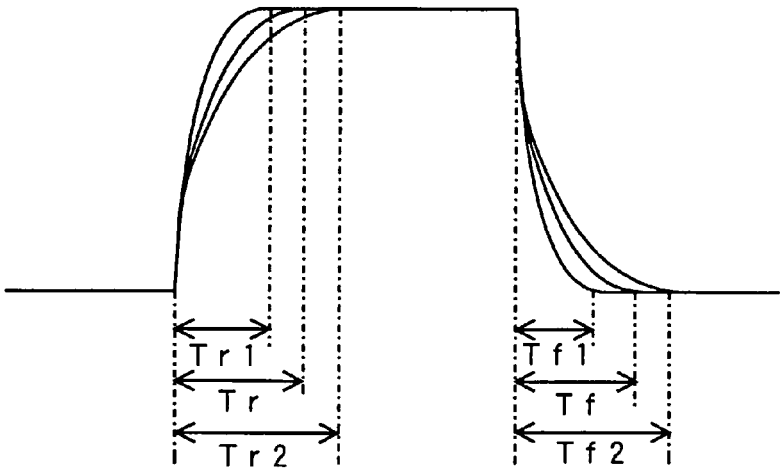

(1) In the illustrated third embodiment, the driver ICs 180, 190 are equipped with the maximum value circuits 187, 197, respectively. In place of the maximum value circuits 187, 197, the driver ICs 180, 190 may be equipped with minimum value circuits. Where the input voltage of a signal (as a setting signal) inputted from an external to each minimum value circuit is lower than the input voltage thereof, the minimum value circuit converts the input voltage thereof into the lower voltage inputted from the external. More specifically described by referring to FIG. 13B, the driver ICs 180, 190 are equipped with minimum value circuits 200, 201, respectively. The reference generating circuit 184 of the driver IC 180 is connected to the minimum value circuit 201 of the driver IC 190 while the reference generating circuit 194 of the driver IC 190 is connected to the minimum value circuit 200 of the driver IC 180. Namely, the output from the reference generating circuit 184 of the driver IC 180 is inputted to the minimum value circuit 201 of the driver IC 190 while the output from the reference generating circuit 194 of the driver IC 190 is inputted to the minimum value circuit 200 of the driver IC 180. Suppose the reference voltage of the driver IC 180 is lower than that of the driver IC 190, for instance. Because, in the driver IC 180 in which the reference voltage is low, the reference voltage outputted from its reference generating circuit 184 is lower than the reference voltage inputted from an external, i.e., from the driver IC 190, the reference voltage outputted from the reference generating circuit 184 is outputted to the conversion circuit 185. In this case, the driver IC 180 functions as an effective master.

On the other hand, because, in the driver IC 190, the reference voltage inputted from an external, i.e., from the driver IC 180 is lower than the reference voltage outputted from its reference generating circuit 194, the minimum value circuit 201 of the driver IC 190 converts the reference voltage outputted from the reference generating circuit 194 thereof into the reference voltage inputted from the external (i.e., from the driver IC 180), namely into the reference voltage outputted from the driver IC 180 as the effective master, and outputs that lower reference voltage to the conversion circuit 195. In other words, where the reference voltages which are respectively outputted from the reference generating circuits of the respective driver ICs are mutually different, the higher one of the reference voltages can be converted into the lower one of the reference voltages. Therefore, this arrangement eliminates the variation in the rise time Tr and the fall time Tf of the drive signals to be outputted from the respective driver ICs, which variation is due to the variation in the reference voltage between the driver ICs. Therefore, this arrangement enjoys the effects (1) and (2) described above with respect to the illustrated third embodiment.

In this modified arrangement (1), the minimum value circuits 200, 201 function as an adjusting portion. Further, the adjusting portion is also provided by respective structure of the driver ICs 180, 190 to set themselves respectively as one and the other of the master and the slave and to convert the reference voltage generated by the reference generating circuit 194 of the driver IC 190 into the reference voltage generated by the reference generating circuit 184. The reference voltage outputted from the reference generating circuit 184 of the driver IC 180 to the minimum value circuit 201 of the driver IC 190 is a reference signal. The reference generating circuit 184 of the driver IC 180 functions as a setting-signal outputting section. The driver IC 180 is one of the plurality of drive circuits which outputs the drive signals having minimum energy.

(2) In the illustrated third embodiment and the modified arrangement (1), the voltage is interpreted as the energy of the drive signals. It is noted that the current or the electric power may be interpreted as the energy of the drive signals. For instance, where the reference currents of the respective driver ICs are mutually different, a higher one of the reference currents may be converted into a lower one of the reference currents or a lower one of the reference currents may be converted into a higher one of the reference currents. Further, the setting of the master and the slave may be carried out based on magnitude of impedance of each reference generating circuit or each conversion circuit.

(3) In the illustrated third embodiment, the setting of the driver ICs 180, 190 as one and the other of the master and the slave may be performed by employing a software technique in which the setting data used for setting the driver ICs 180, 190 as one and the other of the master and the slave is stored in the registers of the respective driver ICs 180, 190. The setting may be performed by employing a hardware technique in which each of the driver ICs 180, 190 is equipped with switching means such as a solder point or a switch which enables the driver ICs 180, 190 to be switched between the master and the slave. These modified arrangements also enjoy the effects (1) and (2) described above with respect to the illustrated third embodiment.

2-4. Other Embodiments (1) In the illustrated first through third embodiments and the modified arrangements thereof, the actuators are driven by the two driver ICs. The principle of the invention is applicable to an ink-jet printer in which the actuators are driven by three or more driver ICs. This is true of the embodiments of the first aspect described above.

(2) The electric structure of the driver ICs explained in the illustrated first through third embodiments and the modified arrangements thereof may be embodied otherwise.

(3) An external circuit such as a resistor circuit may be connected to each driver IC. In the meantime, the characteristic such as the rise time Tr or the fall time Tf of the drive signals outputted from each driver IC may be measured by a measuring device. The external circuit such as the resistor circuit connected to each driver IC may be arranged to be adjusted so as to output a voltage or current required for correcting the measured value to be equal to a target value. This arrangement also enjoys the effects (1) and (2) described above with respect to the illustrated first embodiment. Where this arrangement is practiced, a table (correction table) in which measured value and correction value are related to each other may be stored in the measuring device or in a memory disposed outside of the measuring device. In this case, the correction value may be read out from the correction table and a signal corresponding to the read correction value may be outputted to each driver IC, whereby the characteristic of the drive signals between the mutually different driver ICs may be conformed to each other.

What is claimed is:

1. An ink-jet printer comprising:

an ink-jet head in which are disposed a plurality of nozzles that are divided into a plurality of nozzle groups;

a plurality of actuators which are provided to respectively correspond to the plurality of nozzles and which are divided into a plurality of actuator groups respectively corresponding to the plurality of nozzle groups;

a plurality of drive circuits which are provided respectively for the plurality of nozzle groups and each of which outputs a drive signal used for ejecting an ink, to the plurality of actuators of a corresponding one of the plurality of actuator groups; and a controller which controls the ink-jet printer to perform printing such that, by driving any of the plurality of actuators which are determined on the basis of print data, the ink is ejected, toward a recording medium, from any of the plurality of nozzles that correspond to said any of the plurality of actuators; and a reference-signal outputting section which outputs, to said each of the plurality of drive circuits, a common reference signal of a constant current;

wherein said each of the plurality of drive circuits includes:

a current mirror circuit to which is inputted the common reference signal outputted from the reference-signal outputting section and which supplies, on the basis of the common reference signal, a reference current for the plurality of actuators of a corresponding one of the plurality of actuator groups; and an output circuit which includes a plurality of current amplifiers which respectively correspond to the plurality of actuators of the corresponding one of the plurality of actuator groups and each of which amplifies the reference current supplied from the current mirror circuit, the output circuit outputting the drive signal that is based on the amplified reference current, to each of the plurality of actuators of the corresponding one of the plurality of actuator groups.

2. The ink-jet printer according to claim 1;

wherein the reference-signal outputting section includes a resistor circuit which is connected to a common power source that outputs a reference voltage and which generates the common reference signal of the constant current based on the reference voltage.

3. The ink-jet printer according to claim 2;

wherein a resistance of the resistor circuit is adjustable; and wherein a current value of the drive signal outputted from said each of the plurality of drive circuits is adjusted by adjusting the resistance of the resistor circuit.

4. The ink-jet printer according to claim 2;

wherein a resistance of the resistor circuit is adjustable; and wherein a rise time and a fall time of a pulse of the drive signal outputted from said each of the plurality of drive circuits are adjusted by adjusting the resistance of the resistor circuit.

5. The ink-jet printer according to claim 2;

wherein the resistor circuit is connected to the common power source that is provided separately from any of the plurality of drive circuits.

6. The ink-jet printer according to claim 2;

wherein one of the plurality of drive circuits includes a reference generating circuit for generating a reference voltage; and wherein the resistor circuit is connected to the reference generating circuit as the common power source.

7. The ink-jet printer according to claim 1;

wherein currents of the respective drive signals respectively outputted from the plurality of drive circuits are made equal to each other.

8. The ink-jet printer according to claim 1;

wherein a rise time and a fall time of a pulse of the drive signal outputted from any one of the plurality of drive circuits are made equal to a rise time and a fall time of a pulse of the drive signal outputted from each of the rest of the plurality of drive circuits.

9. The ink-jet printer according to claim 1;

wherein the plurality of nozzles are arranged in a plurality of rows that are respectively provided for a plurality of colors of inks.

10. The ink-jet printer according to claim 1;

wherein the plurality of nozzles are arranged in a plurality of rows and the plurality of nozzle groups are defined by dividing the plurality of rows in a direction of extension of the plurality of rows.

* * * * *